US009849466B2

(12) United States Patent
Martinez et al.

(10) Patent No.: US 9,849,466 B2
(45) Date of Patent: Dec. 26, 2017

(54) METHOD AND APPARATUS FOR CONTINUOUSLY FRACTIONATING PARTICLES CONTAINED WITHIN A VISCOPLASTIC FLUID

(75) Inventors: Dominic Mark Martinez, Vancouver (CA); James Allen Olson, Vancouver (CA); Ario Madani, Vancouver (CA); Ian Alistair Frigaard, Vancouver (CA); Davood Farajisarir, Vancouver (CA); James Lockhart, Vancouver (CA)

(73) Assignee: THE UNIVERSITY OF BRITISH COLUMBIA, Vancouver (CA)

( * ) Notice: Subject to any disclaimer, the term of this patent is extended or adjusted under 35 U.S.C. 154(b) by 948 days.

(21) Appl. No.: 14/129,820

(22) PCT Filed: Jun. 29, 2012

(86) PCT No.: PCT/CA2012/000632
§ 371 (c)(1),
(2), (4) Date: Jun. 9, 2014

(87) PCT Pub. No.: WO2013/000072
PCT Pub. Date: Jan. 3, 2013

(65) Prior Publication Data

US 2014/0296052 A1 Oct. 2, 2014

Related U.S. Application Data

(60) Provisional application No. 61/502,722, filed on Jun. 29, 2011.

(51) Int. Cl.
*B04B 7/08* (2006.01)
*B04B 11/06* (2006.01)
(Continued)

(52) U.S. Cl.
CPC ..... *B04B 7/08* (2013.01); *B03B 5/32* (2013.01); *B03D 3/00* (2013.01); *B04B 1/00* (2013.01); *B04B 11/02* (2013.01); *B04B 11/06* (2013.01)

(58) Field of Classification Search
CPC B04B 7/08; B04B 11/02; B04B 11/06; B04B 1/00; B04B 1/02; B03D 3/00; B03B 5/32
See application file for complete search history.

(56) References Cited

U.S. PATENT DOCUMENTS 3,695,509 A * 10/1972 Javet ..... B01D 17/0217 494/43
4,183,813 A 1/1980 Black et al.
(Continued)

FOREIGN PATENT DOCUMENTS

FR 1407356 7/1965
FR 2703602 A1 * 10/1994 ..... B03B 5/32

OTHER PUBLICATIONS

PCT/CA2012/000632, dated Sep. 26, 2012, International Search Report.

(Continued)

*Primary Examiner* — Charles Cooley
(74) *Attorney, Agent, or Firm* — Ray Quinney & Nebeker; Paul N. Taylor

(57) ABSTRACT

Particles are separated from a source viscoplastic fluid by flowing streams of the viscoplastic fluid and a destination fluid in parallel streamed relationship inside a rotating cylindrical annulus by using baffles to introduce each fluid independently at an inlet lower end of the annulus and for separating the upper streams consisting of an un-yielded source and destination flow proximate the radially innermost side of the annulus, a bulk axial flow in a more central region and a yielded layer destination flow adjacent the radial outermost side of the annulus which contains the particles
(Continued)

that have separated. Inlet and outlet baffles are provided at each end of the vertically oriented device to maintain the flows discrete on entry and to maintain the separated flows discrete on exit so as to facilitate removal of the component flows from the fractionator.

8 Claims, 20 Drawing Sheets

(51) Int. Cl.

| | |
|---|---|
| ***B03B 5/32*** | (2006.01) |
| ***B04B 1/00*** | (2006.01) |
| ***B03D 3/00*** | (2006.01) |
| ***B04B 11/02*** | (2006.01) |

(56) References Cited

U.S. PATENT DOCUMENTS

| | | | | |
|---|---|---|---|---|
| 4,427,541 | A | 1/1984 | Crosby et al. | |
| 4,662,990 | A * | 5/1987 | Bonanno | B01D 1/26 159/20.1 |
| 4,898,571 | A * | 2/1990 | Epper | B04B 1/20 494/26 |
| 5,586,966 | A * | 12/1996 | Wood | B04B 1/00 494/37 |
| 5,935,053 | A * | 8/1999 | Strid | B03B 5/56 494/66 |
| 2014/0296052 | A1* | 10/2014 | Martinez | B03B 5/32 494/37 |
| 2017/0136387 | A1* | 5/2017 | Miller | B01D 17/0217 |

OTHER PUBLICATIONS

Andres, U.T., "Equilibrium and Motion of Spheres in a Viscoplastic Liquid", Soviet Physics. Doklady, vol. 133, No. 4, pp. 723-726, Aug. 1960, 5 pages.
Boysan, F., et al., "A Fundamental Mathematical Modelling Approach to Cyclone Design", Transcations of the Institution of Chemical Engineering and Fuel Technology, vol. 60, 1982, p. 222-230.
Madani, A., et al., "Novel Fractionation Methods: Separation in a Viscoplastic Fluid", Dept. of Mechanical Engineering, The University of British Columbia, May 19, 2009, 30 pages.
Vomhoff, H., et al., "Fractionation of a Bleached Softwood Pulp and Separate Refining of the Earlywood- and Latewood-Enriched Fractions", IPW: International Paperwood, vol. 2, Feb. 2003, p. 37-41.
Julien Saint Amand, F. et al., Fundamentals of screening: Effect of rotor design and fibre properties, Tappi Pulping Conf., 1999, 941-945.
Olson, J.A. et al., Fibre fractionation for high-porosity sack Kraft paper, Paprican Pulp and Paper Report, 1999, 1432.
Olson, J.A. et al., Fibre length fractionation caused by pulp screening: Smooth-hole screen plates, J. Pulp Paper Sci., 2000, 26(1), 12-16.
Olson, J.A., Fibre length fractionation caused by pulp screening: slotted screen platesm J. Pulp Paper Sci., 2001, 27(8), 255-261.
Paavilainen, L., The Possibility of fractionating softwood sulfate pulp according to cell wall thickness, Appita J., 1992, 45(5), 319-326.
Batchelor, G.K., Sedimentation in a dilute dispersion of spheres, J. Fluid Mech., 1972, 123, 245-248.
Mackaplow, M.B., et al., A numerical study of the sedimentation of fibre suspensions, J. Fluid Mech., 1998, 376, 149-182.
Jayaweera, K.O.L.F. et al., The behaviour of freely falling cylinders and cones in a viscous fluid, J. Fluid Mech., 1976, 22, 709-720.
Kumar, P. et al. Enhancement of the sedimentation rates of fibrous suspensions, Chem. Engng. Comm., 1991, 108, 381-401.
Herzhaft, B. et al., Experimental study of the sedimentation of dilute and semi-dilute suspensions of fibres, J. Fluid Mech, 1999, 384, 133-158.
Richardson, J.F., et al., Sedimentation and fluidisation, Part 1, Trans. Instn Chem. Engrs., 1954, 32, 35-53.
Butler, J.E. et al., Dynamic simulations of inhomogenous sedimentation of rigid fibres, J. Fluid Mech., 1989, 468, 205-237.
Koch, D.L. et al., The instability of a dispersion of a dispersion of settling spheroids, J. Fluid Mech., 1989, 224, 275-303.
Marton, R. et al., Characterization of mechanical pulps by settling technique, TAPPI J., 1969, 2(12), 2400-2406.
Feng, J. et al., Direct simulation of initial value problems for the motion of solid bodies in a Newtonian fluid, Part 1—Sedimentation, J. Fluid Mech., 1998, 261, 95-134.
Jianzhong, L. et al., Effects of the aspect ratio on the sedimentation of a fiber in Newtonian fluids, J. Aer. Sci., 2003, 34, 909-921.
Salmela, J. et al., Sedimentation of dilute and semi-dilute rigid fibre suspensions at finite Re, AlChE J., 2007, 53(8), 1916-1923.
Ko, J., Numerical modeling of highly swirling flows in a cylindrical through flow hydrocyclone. Licentiate Thesis, 2005, KTH Sweden.
Narashima, M., et al., Review of CFD modelling for performance prediction of hydrocyclones, Engineering Applications of Computational Fluid Mechanics, 2007, 1(2), 109-125.
Nowakowski, A.F., et al., Investigation of swirling flow structure in hydrocyclones, Trans IChemE, 2003, 81(A), 862-874.
Bergstrom, J., et al., Experimental hydrocyclone flow field studies, Separation and Purification Technology, 2007, 53(1), 8-20.
Hsieh, K.T. et al., Mathematical model of the hydrocyclone based on physics of fluid flow, AlChE J., 1991, 37(5), 735-746.
Sevilla, E.M. et al.; The fluid dynamics of hydrocyclones, J. Pulp Pap. Sci., 1997, 23(2), 85-93.
Ma, L. et al., Numerical modeling of the fluid and particle penetration through sampling cyclones, J. Aer. Sci., 2000, 31(9), 1097-1119.
Blackbery, J. et al., Creeping motion of a sphere in tubes filled with a Bingham plastic material, J. Non-Newtonian Fluid Mech., 1997, 70, 59-77.
Liu, B.T. et al., Convergence of a regularization method for creeping flow of a Bingham material around a rigid sphere, J. Non-Newtonian Fluid Mech., 2002, 102, 179-191.
Beauline, M. et al., Creeping motion of a sphere in tubes filled with Herschel-Bulkley fluids, J. Non-Newtonian Fluid Mech., 1997, 72, 55-71.
Jie, P. et al., Drag force of interacting coaxial spheres in viscoplastic, J. Non-Newtonian Fluid Mech., 2006, 135, 83-91.
Frigaard, I.A., et al., On the usage of viscosity regularization methods for visco-plastic fluid flow computation, J. Non-Newtonian Fluid Mech., 2005, 127, 1-26.
Beris, A.N. et al., Creeping motion of a sphere through a Bigham plastic, J. Fluid Mech., 1985, 158, 219-244.
Putz, A., et al., Settling of an isolated spherical particle in a yield stress fluid, Phys. Fluids, 2008, 20(3), 033102-033102,11.
Tabuteau, H. et al., Drag force on a sphere in steady motion through a yield stress fluid, J. Rheol., 2007, 51, 125-137.
Laxton, P.B. et al., Gel trapping of dense colloids, J. Colloid Interface Sci., 2005, 285, 152-157.
Roquet, N. et al., An adaptive finite element method for Bingham fluid flows around a cylinder, Comput. Methods Appl. Mach. Eng., 1983, 192, 3317-3341.
Gueslin, B. et al., Aggregation behavior of two spheres falling through an aging fluid, Phys. Rev., 74, 2006, 042501.
Attapatu, D.D., et al., Creeping sphere motion in Herschel-Bulkley fluids: Flow field and drag, J. Non-Newtonian Fluid Mech., 1995, 59, 245-265.
Jossic, L., et al., Drags and stability of objects in a yield stress fluid, AlChE J., 2001, 47, 2666-2672.
Matvienko, O.V., et al., Hydrodynamics of the Bingham Slurry and Particle Separation in the Hydrocyclone, Partec 2007: International Congress for Particle Technology, Mar. 27-29, 2007, Nurmberg, Germany.

* cited by examiner

METHOD AND APPARATUS FOR CONTINUOUSLY FRACTIONATING PARTICLES CONTAINED WITHIN A VISCOPLASTIC FLUID

CROSS REFERENCE TO RELATED APPLICATIONS

This application is a U.S. Nationalization of PCT Application Number PCT/CA2012/000632, filed on Jun. 29, 2012, which claims priority to U.S. Provisional Patent Application No. 61/502,722, filed on Jun. 29, 2011, the entireties of which are incorporated herein by reference.

TECHNICAL FIELD

The present disclosure is directed at a method and apparatus for continuously fractionating particles contained within a viscoplastic fluid. More particularly, the present disclosure is directed at a method and apparatus for continuously fractionating particles undergoing substantially non-Brownian motion by applying centrifugal force to the particles while they are contained in the viscoplastic fluid and being transported in a direction having a component orthogonal to the centrifugal force.

BACKGROUND

Fractionating particles refers to dividing particles into groups according to one or more of the particles' characteristics. For example, in the pulp and paper industry, pulp fibres may be fractionated based on their lengths. Fractionating pulp fibres based on their lengths can be beneficial because short pulp fibres can be used to manufacture a short fibred paper that is particularly useful for printing, while long paper fibres can be used to manufacture a long fibred paper that has particularly high tensile strength. Fractionating particles can be similarly beneficial in other industries.

Accordingly, research and development continues into methods and apparatuses for fractionating particles.

SUMMARY

According to a first aspect, there is provided an apparatus for continuously fractionating particles within a viscoplastic fluid. The apparatus includes a body rotatable about an axis of rotation, the body comprising: (i) an inner wall and an outer wall rotatable in unison and defining a fractionation conduit therebetween that extends non-orthogonally relative to the axis of rotation; and (ii) an outlet baffle rotatable in unison with the inner and outer walls and shaped to separate fluid flowing along the fractionation conduit into two fractions. The apparatus also includes a source fluid supply conduit, a source fluid exit conduit, and a destination fluid exit conduit each fluidly coupled to the fractionation conduit, the destination and source fluid exit conduits coupled to the fractionation conduit on opposing sides of the outlet baffle and the source fluid supply conduit longitudinally spaced from the exit conduits such that the particles in a source viscoplastic fluid conveyed through the source fluid supply conduit are fractionated along the fractionation conduit and are conveyed out the destination fluid exit conduit.

The apparatus may also include a destination fluid supply conduit fluidly coupled to the fractionation conduit; and an inlet baffle rotatable in unison with the inner and outer walls, wherein the source fluid supply conduit is fluidly coupled to the fractionation conduit on one side of the inlet baffle and the destination fluid supply conduit is fluidly coupled to an opposing side of the inlet baffle and the inlet baffle is shaped such that the source viscoplastic fluid and a destination viscoplastic fluid pumped into the conduit on either side of the inlet baffle and out of the conduit on either side of the outlet baffle comprise a stable multilayer flow when between the inlet and outlet baffles.

Each of the source and destination fluid supply conduits may extend collinearly relative to the axis of rotation into opposing ends of the body.

The apparatus may also include a spindle within which the destination fluid supply conduit extends and on which the apparatus rotates when operating.

Each of the source and destination fluid exit conduits may extend collinearly relative to the axis of rotation.

Each of the source and destination fluid conduits may be sufficiently long to allow the source and destination fluids, respectively, to allow the velocity profiles of the source and destination fluids to fully develop prior to entering the fractionation conduit.

The destination fluid exit conduit may comprise piping extending into the body, the source fluid exit conduit may comprise piping extending within the piping of the destination fluid exit conduit, and the destination fluid supply conduit may comprise piping extending within the piping of the source fluid exit conduit.

A pump may be located along the destination fluid exit conduit and another pump may be located along the supply fluid exit conduit.

The inlet baffle may comprise a curved cylindrical wall.

The inlet baffle may also comprise a flat end plate to which the curved cylindrical wall is fixedly coupled, wherein the flat end plate is securely positioned between the inner and outer walls. Alternatively, the inlet baffle may also comprise an end plate to which the curved cylindrical wall is fixedly coupled, wherein the end plate is securely positioned between the inner and outer walls and wherein the end plate and outer wall are bent away from the interior of the body in a direction non-orthogonal relative to the axis of rotation.

The inner and outer walls may be parallel along the length of the fractionation conduit.

The inlet and outlet baffles may extend along the fractionation conduit parallel to the inner and outer walls.

The inlet and outlet baffles may be positioned at different radial distances from the axis of rotation.

According to another aspect, there is provided a method for continuously fractionating particles within a viscoplastic fluid. The method includes flowing one stream of the viscoplastic fluid having the particles to be fractionated and a second type of particles therein ("source fluid") in a direction that is non-orthogonal relative to an axis of rotation such that the source fluid experiences laminar spiral Poiseuille flow; subjecting the source fluid to solid body rotation about the axis of rotation such that the particles to be fractionated experience centrifugal force equaling or exceeding resistive forces corresponding to the yield stresses of the viscoplastic fluid and such that the second type of particles experiences centrifugal force less than the resistive force corresponding to the yield stresses of the viscoplastic fluid while maintaining laminar spiral Poiseuille flow; continuing flowing and rotating the source fluid until the particles to be fractionated migrate sufficiently from the second type of particles to be separately collected from the second type of particles; and collecting the particles that have been fractionated.

The method may also include flowing another stream of fluid ("destination fluid") parallel to the source fluid, wherein the source fluid is nearer to the axis of rotation than the destination fluid and wherein the destination and source fluids contact each other and comprise a stable multilayer flow; subjecting the source and destination fluids to solid body rotation about the axis of rotation such that the particles to be fractionated experience centrifugal force equaling or exceeding resistive forces corresponding to the yield stress of the source fluid and such that the second type of particles experiences centrifugal force less than the resistive force corresponding to the yield stress of the source fluid while maintaining the stable multilayer flow; and continuing flowing and rotating the destination and source fluids until the particles to be fractionated migrate from the source fluid into the destination fluid. The particles to be fractionated can be collected from the destination fluid.

The destination fluid may comprise a viscoplastic fluid, and wherein the source and destination fluids are subjected to solid body rotation such that the particles to be fractionated experience centrifugal force equaling or exceeding resistive forces corresponding to the yield stresses of the source and destination fluids and such that the second type of particles experiences centrifugal force less than the resistive force corresponding to the yield stresses of the source and destination fluids.

The direction in which the destination and source fluids flow may be parallel to the axis of rotation.

The source and destination fluids may comprise the same type of viscoplastic fluid.

The source and destination fluids may be subjected to solid body rotation prior to contacting them together.

The method may also include fully developing the velocity profiles of the source and destination fluids prior to contacting them together by pumping the source and destination fluids along the axis of rotation.

The source and destination fluids may be subjected to solid body rotation in a fractionation conduit and the method may also include introducing the source and destination fluids simultaneously through a single inlet conduit to the fractionation conduit prior to being subjected to solid body rotation, wherein the source and destination fluids have sufficiently different densities such that they separate into two fractions prior to collecting the particles that have been fractionated.

According to another aspect, there is provided an apparatus for continuously fractionating particles within a viscoplastic fluid. The apparatus includes a body rotatable about an axis of rotation, the body comprising: (i) opposing end faces; (ii) an inner wall and an outer wall configured to be rotated in unison, the inner and outer walls located between the opposing end faces and defining a conduit therebetween extending longitudinally in a direction having a component parallel to the axis of rotation; and (iii) an inlet baffle and an outlet baffle each extending longitudinally in a direction having a component parallel to the axis of rotation along a fraction of the conduit such that source and destination viscoplastic fluids pumped into the conduit on either side of the inlet baffle and out of the conduit on either side of the outlet baffle comprise a stable multilayer flow when between the inlet and outlet baffles, wherein the source fluid is nearer to the axis of the rotation than the destination fluid when the fluids are in the stable multilayer flow, and wherein the inlet and outlet baffles are configured to rotate in unison with the inner and outer walls. The body also comprises inlet and outlet mounting blocks through which the body is inserted and relative to which the body is rotatable, the inlet mounting block comprising destination and source fluid supply conduits that are fluidly coupled to the conduit on opposing sides of the inlet baffle during at least a portion of a full rotation of the body, and the outlet mounting block comprising destination and source fluid exit conduits that are fluidly coupled to the conduit on opposing sides of the outlet baffle during at least a portion of the full rotation of the body.

The inner and outer walls and the inner and outer baffles may be fixedly coupled to each other.

The source and destination fluid supply conduits may be respectively fluidly coupled to the opposing sides of the inlet baffle via source and destination fluid inlets, and the source and destination fluid exit conduits may be respectively fluidly coupled to the opposing sides of the outlet baffle via source and destination fluid outlets.

The source and destination fluid inlets and outlets may carry the fluid across the outer wall.

The source and destination fluid inlets and outlets may carry the fluid across the opposing end faces.

The baffles may extend longitudinally in a direction parallel to the sides of the conduit.

The inner and outer walls may comprise concentric cylinders.

The baffles may comprise concentric cylinders having identical radii measured from the axis of rotation. Alternatively, the baffles may be frustoconical. Alternatively, the inner and outer walls may comprise concentric cylinders; the baffles comprise concentric cylinders having identical radii; and the concentric cylinders that comprise the inner and outer walls and the baffles may be concentric with each other.

Each of the destination and source fluid inlets and outlets may circumscribe the conduit.

The destination and source fluid inlets and outlets may lie in a plane that is perpendicular to the axis of rotation.

The conduit may extend parallel to the axis of rotation.

The apparatus may also include a rod that is collinear with the axis of rotation that extends through and is fixedly coupled to the end faces. The rod may be spaced from the inner wall.

According to another aspect, there is provided a method for continuously fractionating particles within a viscoplastic fluid. The method includes flowing one stream of the viscoplastic fluid having the particles to be fractionated and a second type of particles therein ("source fluid") in a direction that has a component parallel to an axis of rotation; flowing another stream of viscoplastic fluid ("destination fluid") parallel to the source fluid, wherein the source fluid is nearer to the axis of rotation than the destination fluid and wherein the destination and source fluids contact each other and comprise a stable multilayer flow; subjecting the source and destination fluids to solid body rotation about the axis of rotation such that the particles to be fractionated experience centrifugal force equaling or exceeding resistive forces corresponding to the yield stresses of the viscoplastic fluids and such that the second type of particles experiences centrifugal force less than the resistive force corresponding to the yield stresses of the viscoplastic fluids while maintaining the stable multilayer flow; continuing flowing and rotating the destination and source fluids until the particles to be fractionated migrate from the source fluid into the destination fluid; and obtaining the particles to be fractionated from the destination fluid.

The direction in which the destination and source fluids flow may be parallel to the axis of rotation.

The source and destination fluids may comprise the same type of viscoplastic fluid.

According to another aspect, there is provided a non-transitory computer readable medium having encoded thereon statements and instruction to cause a controller to perform a method according to any of the foregoing aspects.

This summary does not necessarily describe the entire scope of all aspects. Other aspects, features and advantages will be apparent to those of ordinary skill in the art upon review of the following description of specific embodiments.

BRIEF DESCRIPTION OF THE DRAWINGS

In the accompanying drawings, which illustrate one or more exemplary embodiments:

FIG. 9(*c*) is a side elevation view of a fastener that can be used to fasten together various components used to manufacture the apparatus of FIG. 1 to facilitate solid body rotation.

DETAILED DESCRIPTION

Directional terms such as "top," "bottom," "upwards," "downwards," "vertically" and "laterally" are used in the following description for the purpose of providing relative reference only, and are not intended to suggest any limitations on how any article is to be positioned during use, or to be mounted in an assembly or relative to an environment.

A viscoplastic fluid is a fluid that, when subjected to a shear stress up to an amount referred to as its "yield stress" ($\tau_y$), behaves as a solid and that, when subjected to a shear stress equaling or exceeding its yield stress, behaves as a fluid. This property of viscoplastic fluids allows them to be used to fractionate particles, as described in the embodiments that follow. In particular, to perform fractionation using the viscoplastic fluid according to one embodiment, at least two types of particles are embedded in the fluid: the first type of particles is the particles to be fractionated ("target particles") and they have in common one or more properties such as specific surface, length, shape, and density; all other particles in the viscoplastic fluid are the particles from which the target particles are to be separated. The viscoplastic fluid containing the particles is rotated about an axis of rotation at a particular angular velocity such that the fluid experiences solid body rotation and all the particles apply a centrifugal force to the viscoplastic fluid. Only the target particles experience a force equaling or exceeding the resistive force corresponding to the fluid's yield stress; consequently, the target particles are able to radially migrate away from the axis of rotation and all non-target particles, and can then be collected. Beneficially, in the following embodiments the viscoplastic fluid moves not just rotationally, but also longitudinally in a direction having a component that is parallel (i.e. non-orthogonal) to the axis of rotation; this longitudinal movement is referred to as "bulk axial flow". The rotational motion results in the target particles moving to a region within the viscoplastic fluid from where they can be collected, while the bulk axial flow allows fractionation to occur continuously. Unyielded portions of the viscoplastic fluid serve to dampen long-range hydrodynamic disturbances acting between the particles carried in the fluid, which helps to reduce stochastic disturbances and to maintain fractionation efficiency. The particles in the fluid are sized such that their motion is substantially or entirely non-Brownian; that is, while the particles' motion may have some non-Brownian characteristics, their motion is nonetheless predominantly Brownian.

Figure 1:
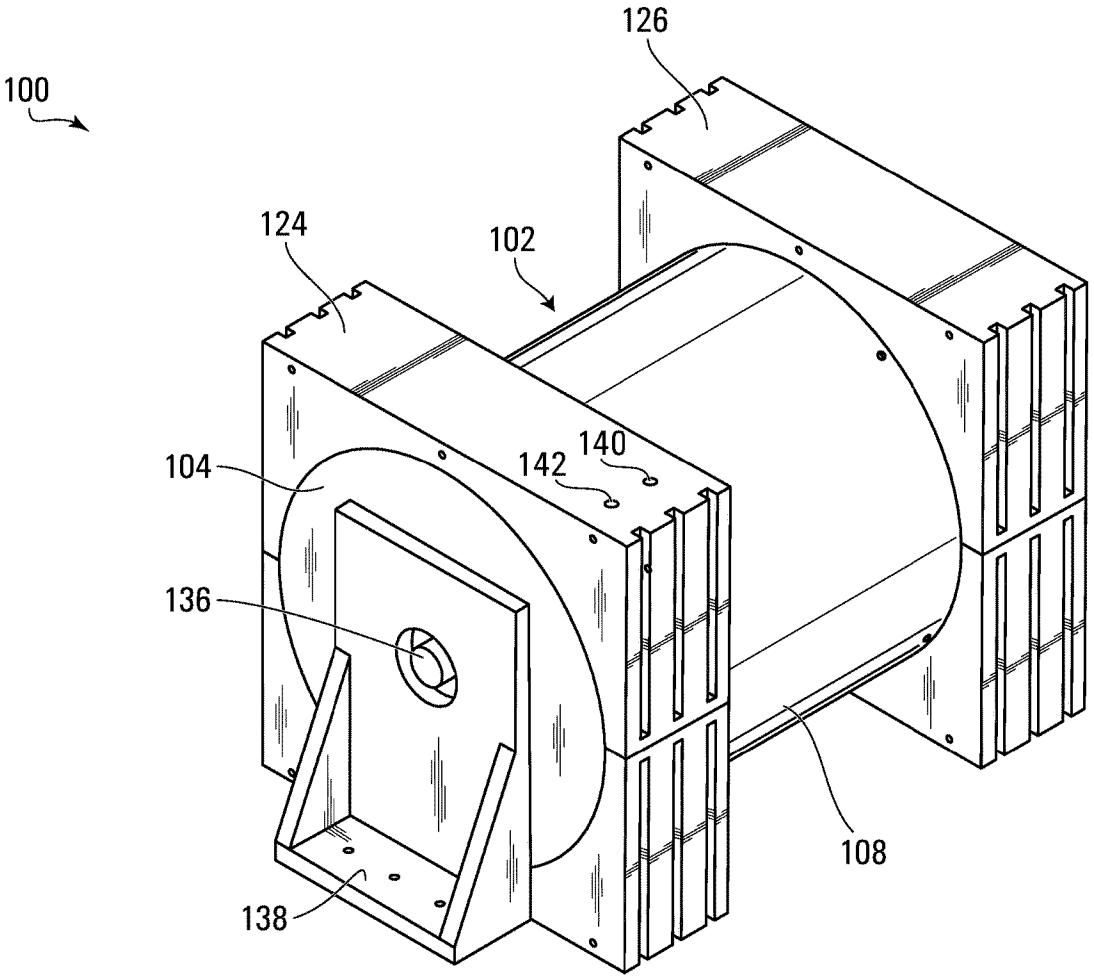
FIG. 1 is a perspective view of an apparatus for fractionating particles, according to one embodiment.
Figure 2:
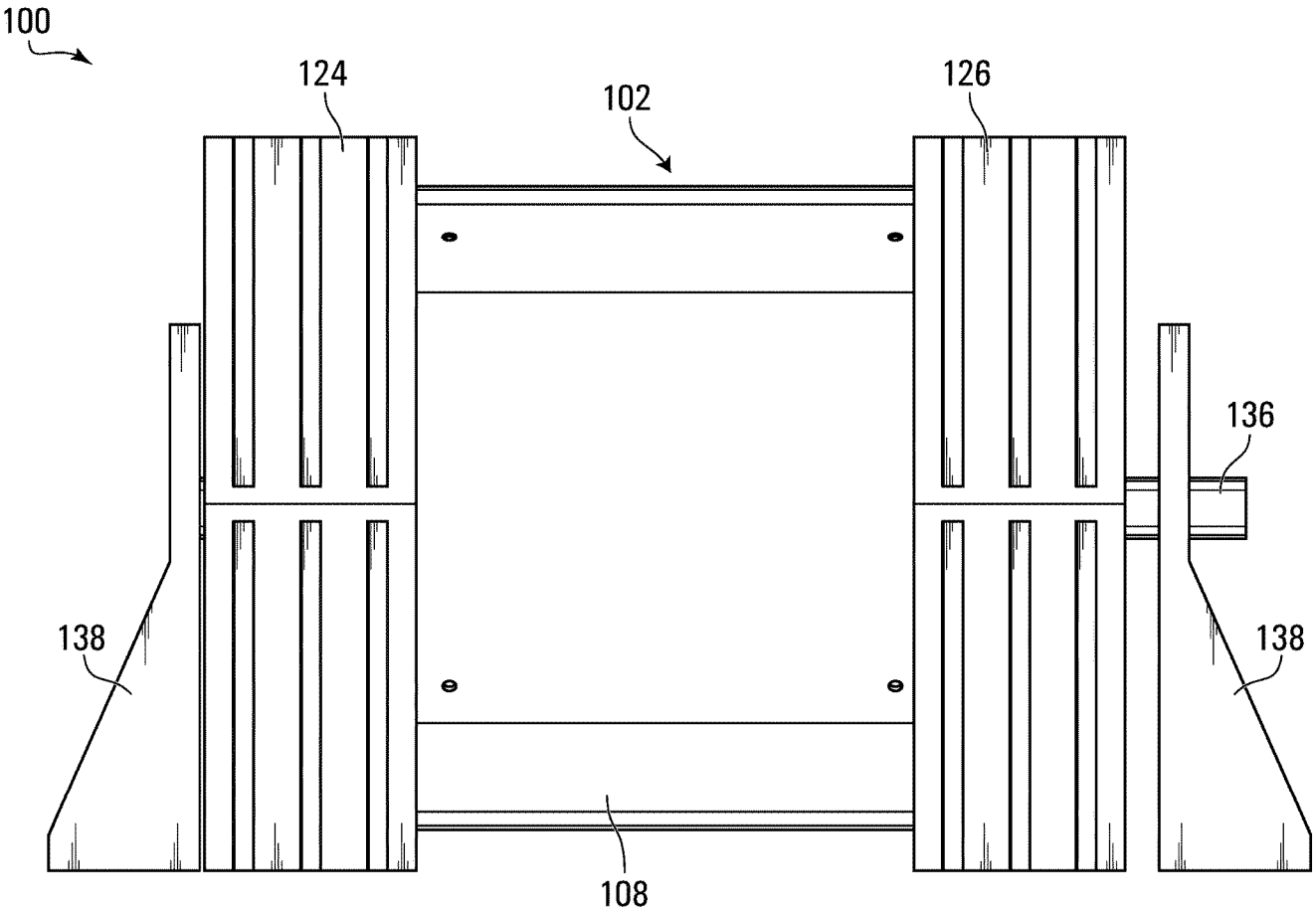
FIG. 2 is front elevation view of the apparatus of FIG. 1.
Figure 3:
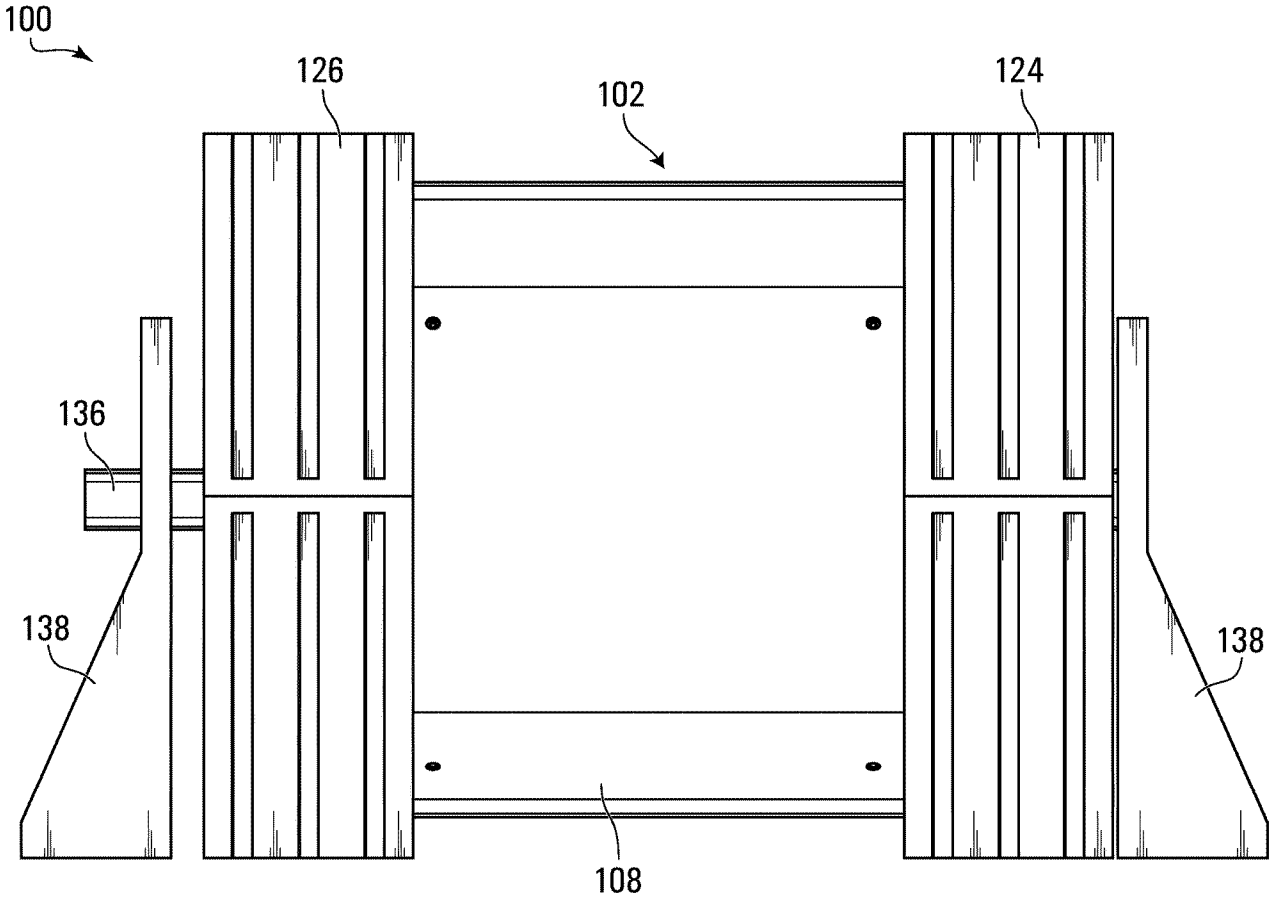
FIG. 3 is a rear elevation view of the apparatus of FIG. 1.
Figure 4:
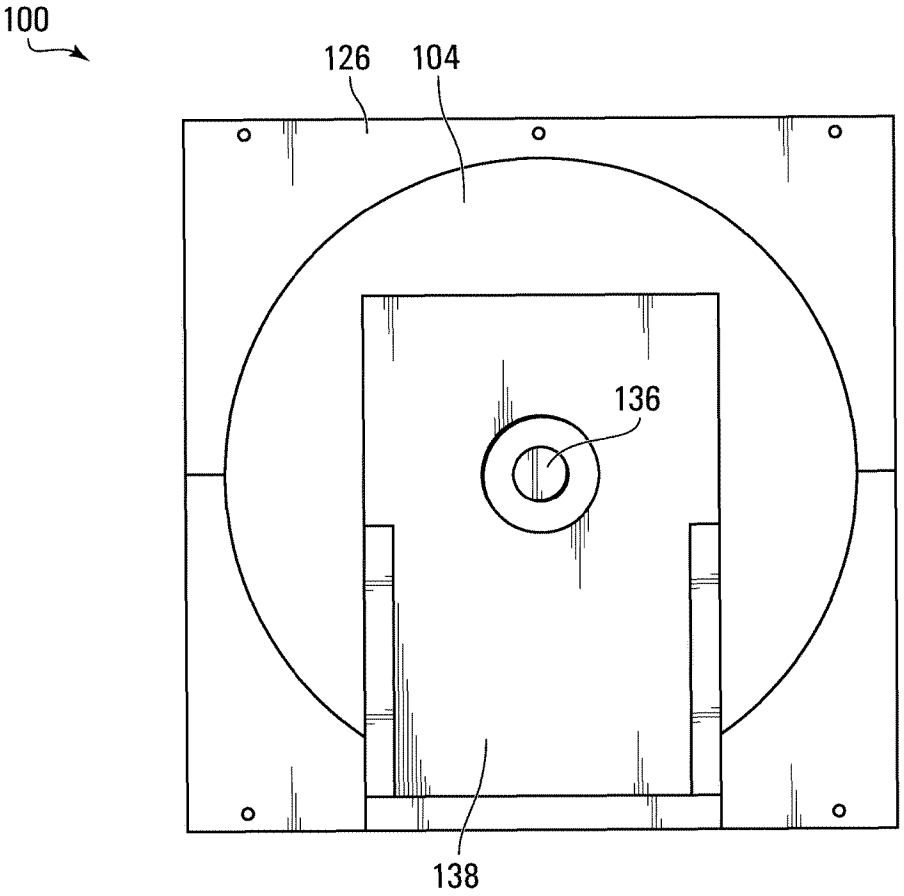
FIG. 4 is a right side elevation view of the apparatus of FIG. 1.
Figure 5:
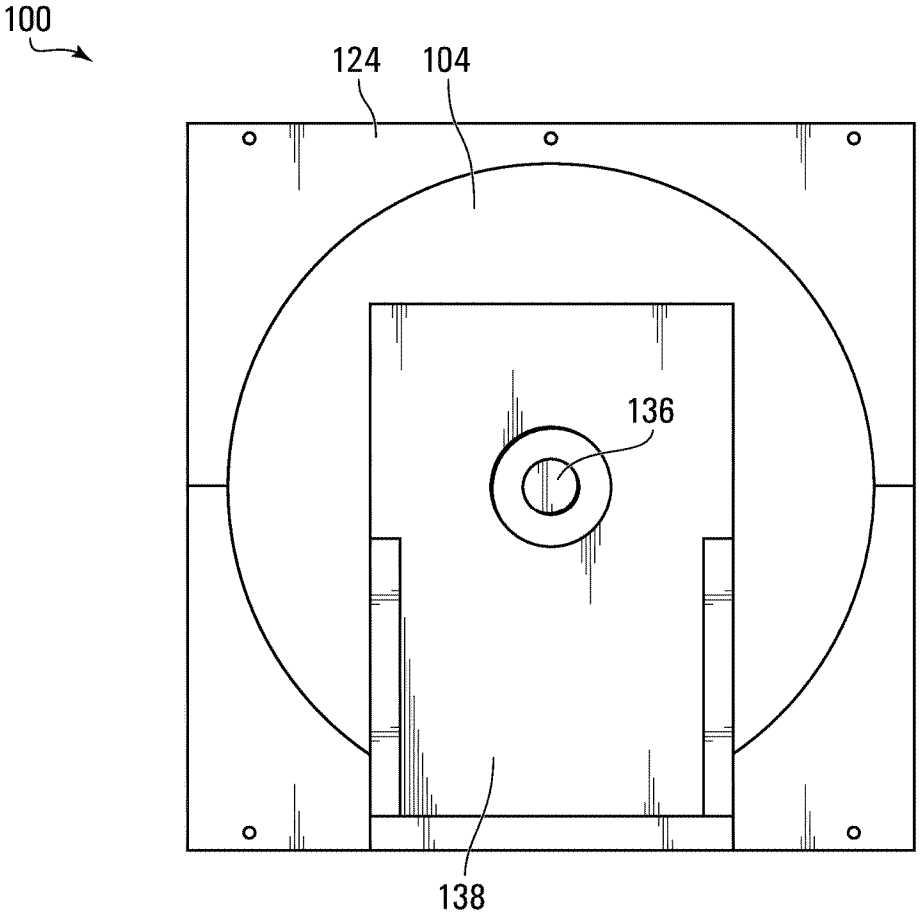
FIG. 5 is a left side elevation view of the apparatus of FIG. 1.
Figure 6:
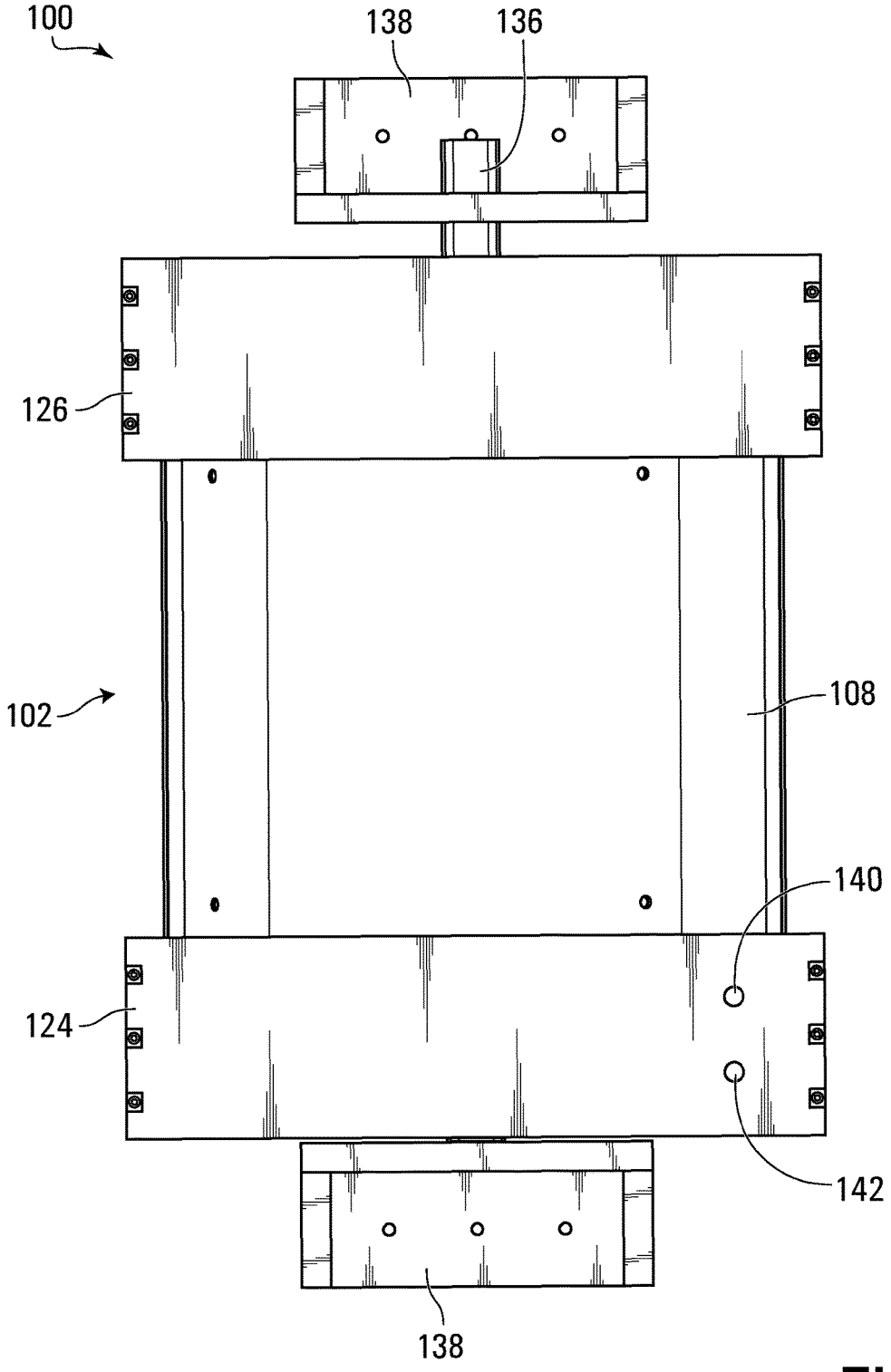
FIG. 6 is a top plan view of the apparatus of FIG. 1.
Figure 7:
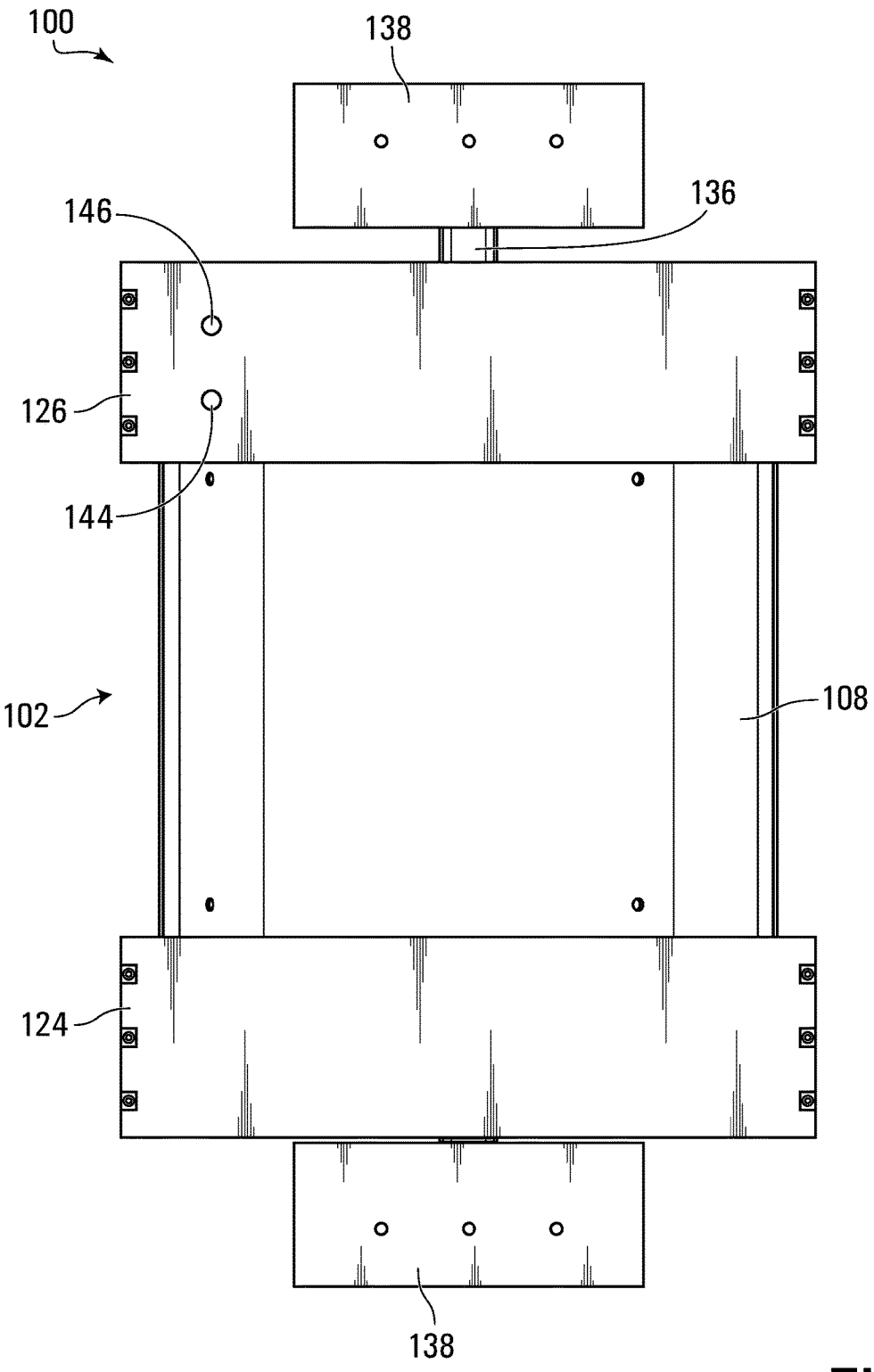
FIG. 7 is a bottom plan view of the apparatus of FIG. 1.
Figure 8:
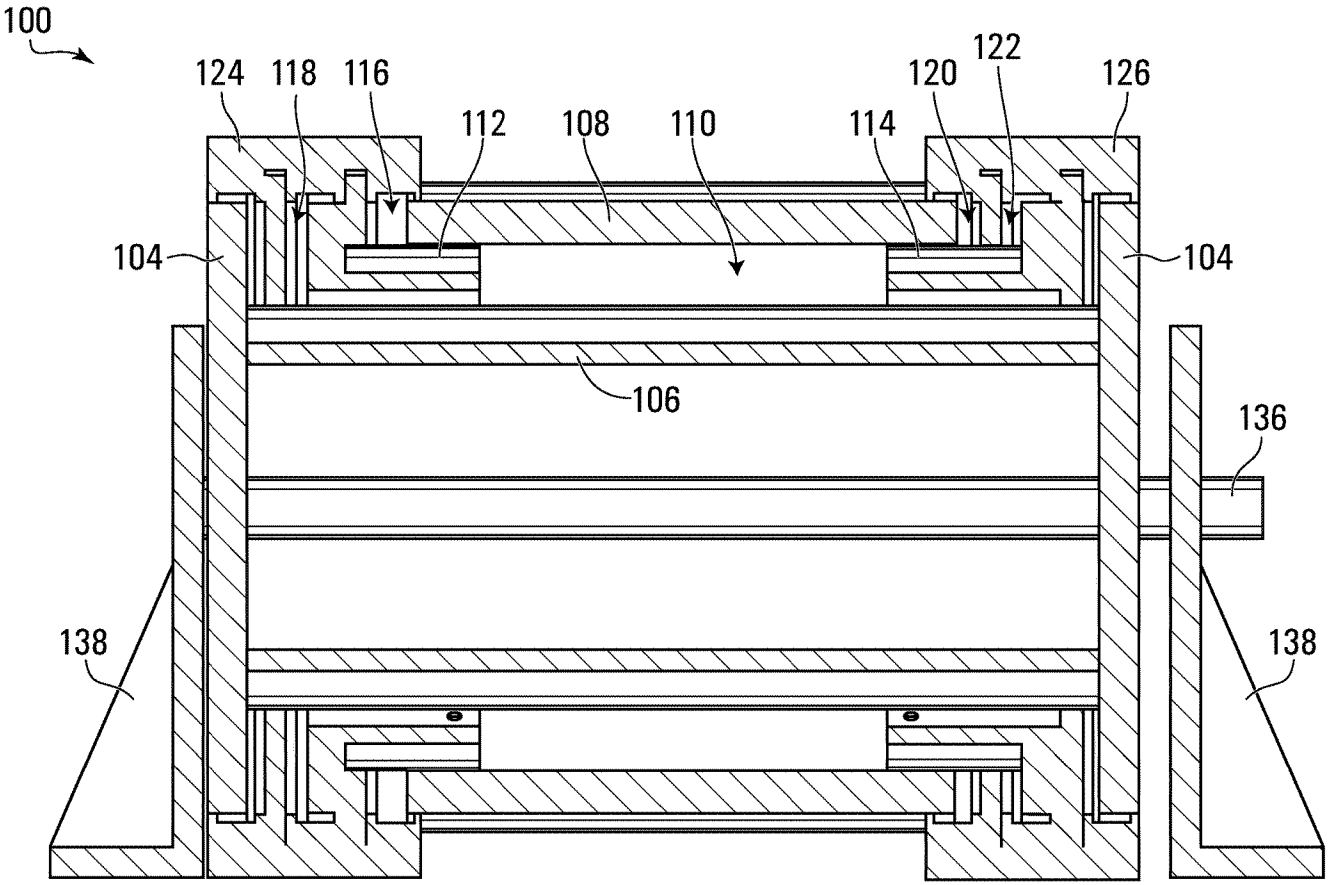
FIG. 8 is a side sectional view of the apparatus of FIG. 1.

Referring now to FIGS. 1 to 8, and to a first embodiment, there is shown an apparatus 100 for fractionating particles, hereinafter referred to as a "fractionator." FIG. 1 shows a perspective view of the fractionator 100; FIGS. 2 and 3 are front and rear elevation views of the fractionator 100, respectively; FIGS. 4 and 5 are right and left side elevation views of the fractionator 100, respectively; FIGS. 6 and 7 are top and bottom plan views of the fractionator 100, respectively; and FIG. 8 is a side sectional view of the fractionator 100. The fractionator 100 is composed of a substantially cylindrical body 102 that includes opposing end faces 104. The body 102 is mounted on an inlet mounting block 124 and an outlet mounting block 126, which are discussed in more detail in respect of FIGS. 9(*a*) and (*b*), below. The fractionator 100's body 102 is rotatable about an axis of rotation that is collinear with the longitudinal axis of the body 102. In the embodiments shown in FIGS. 1 to 8, a rod 136 extends along the fractionator 100's axis of rotation and is fixedly attached to the end faces 104 such that rotating the rod 136 at a particular angular velocity also rotates the body 102 at the same angular velocity. Two rod supports 138, which are spaced from the end faces 104, support the rod 136 and allow the body 102 to be rotated without scraping against a flat surface on which the fractionator 100 may be resting.

In addition to the end faces 104, the fractionator 100's body 102 includes an outer wall 108 and an inner wall 106. The outer wall 108 is visible from the exterior of the fractionator 100, while the inner wall 106 is not. Both the inner and outer walls 106, 108 are cylindrical surfaces that are concentric with each other and that have longitudinal axes collinear with the fractionator 100's axis of rotation. The radius of the inner wall 106 is less than that of the outer wall 108's, and the spacing between the two walls 106, 108 that results from this difference in radii is used as a fractionation conduit 110 through which a viscoplastic fluid may flow. The size of the fractionation conduit 110 is chosen such that (i) the fluid translates and rotates while in the laminar state; (ii) the unyielded region of the fluid located centrally within the fractionation conduit 110 is large in comparison to the characteristic size of the particle measure in the direction of the centrifugal force; and (iii) the difference in radii between the inner and outer walls 106, 108 is small in comparison to the length of the fractionation conduit 110 so that fractionation occurs under fully-developed flow conditions. The bounds in which the laminar state occurs are a balance between the magnitude of the yield stress and the frictional pressure drop created by the flowing fluid, and the centrifugal force created by rotation of the fractionator 100. The frictional pressure drop, as well as the centrifugal forces, are dictated by the location of the inner and outer walls 106, 108.

The inner wall 106 is attached to the end faces 104, while each of the ends of the outer wall 108 is spaced from the end faces 104. The spacing between one of the ends of the outer wall 108 and one of the end faces 104 is used as a fluid inlet (not labelled) to the fractionation conduit 110, whereas the spacing between the other of the ends of the outer wall 104 and the other of the end faces 104 is used as a fluid outlet (not labelled) from the fractionation conduit 110. When the fractionator 100 is operating, the viscoplastic fluid enters the fractionation conduit 110 through the fluid inlet, travels along the fractionation conduit 110, and exits the fractionation conduit 110 through the fluid outlet. An inlet baffle 112 divides the fluid inlet into a destination fluid inlet 116 and a source fluid inlet 118, while an outlet baffle 114 divides the fluid outlet into a destination fluid outlet 120 and a source fluid outlet 122. During operation of the fractionator 100, a "destination fluid" and a "source fluid" are pumped through the fractionation conduit 110; the source and destination fluids may be formulated from the same viscoplastic fluid, or they may be formulated using different viscoplastic fluids. For most of the time the destination and source fluids are in the fractionation conduit 110, they are contacting each other; as discussed in further detail below, the baffles 112, 114 are designed such that, and the destination and source fluids are pumped into the fractionation conduit 110 at a velocity such that, any mixing or turbulent flow between the fluids is kept relatively low and such that the destination and source fluids together form a stable multilayer flow as they experience bulk axial flow along the fractionation conduit 110.

When initially pumped into the fractionator 100, the source fluid is particle laden as it contains the target particles as well as one or more other types of particles from which the target particles are to be separated, while the destination fluid is particle depleted as it is free of the target particles and, in the depicted embodiments, contains no particles at all. As the source fluid inlet and outlet 118, 122 are nearer to the end faces 104 of the fractionator 100 than are the destination fluid inlet and outlet 116, 120, as the destination and source fluids are pumped through the fractionation conduit 110 the source fluid remains closer to the axis of rotation than the destination fluid. Consequently, and as discussed in more detail below, when the body 102 of the fractionator 100 rotates the centrifugal force that results pushes the target particles from the source fluid and into the destination fluid while the destination and source fluids are flowing through the fractionation conduit 110 as a stable multilayer flow. At the destination and source fluid outlets 120, 122, the target particles can be removed from the destination fluid.

Figure 9B:
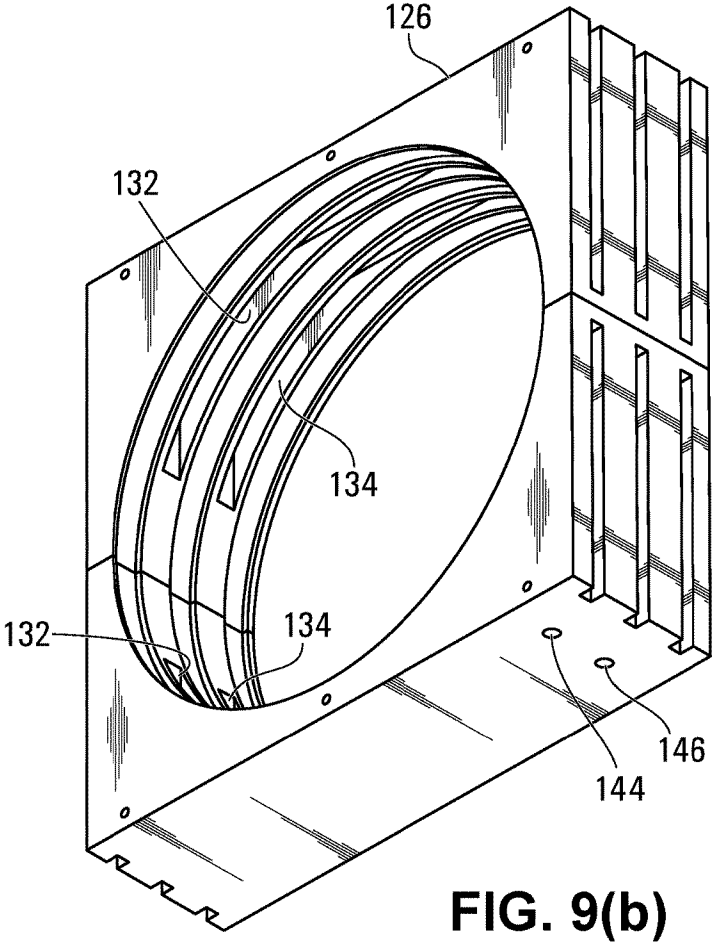
FIGS. 9(*a*) and (*b*) are perspective views of inlet and outlet mounting blocks, respectively, that form part of the apparatus of FIG. 1.
Figure 9A:
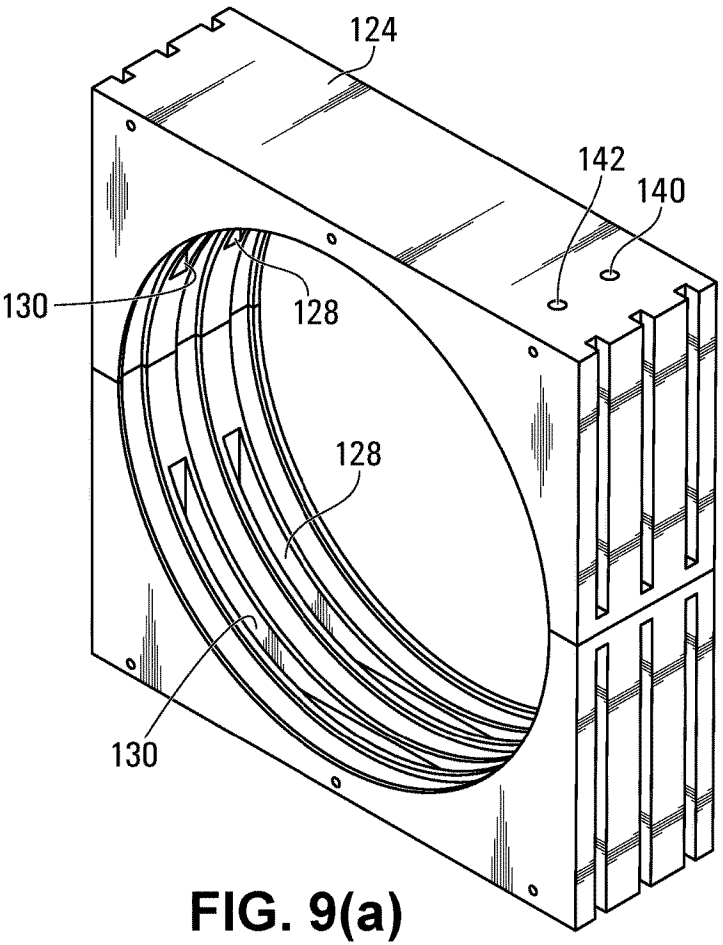
Figure 9C:
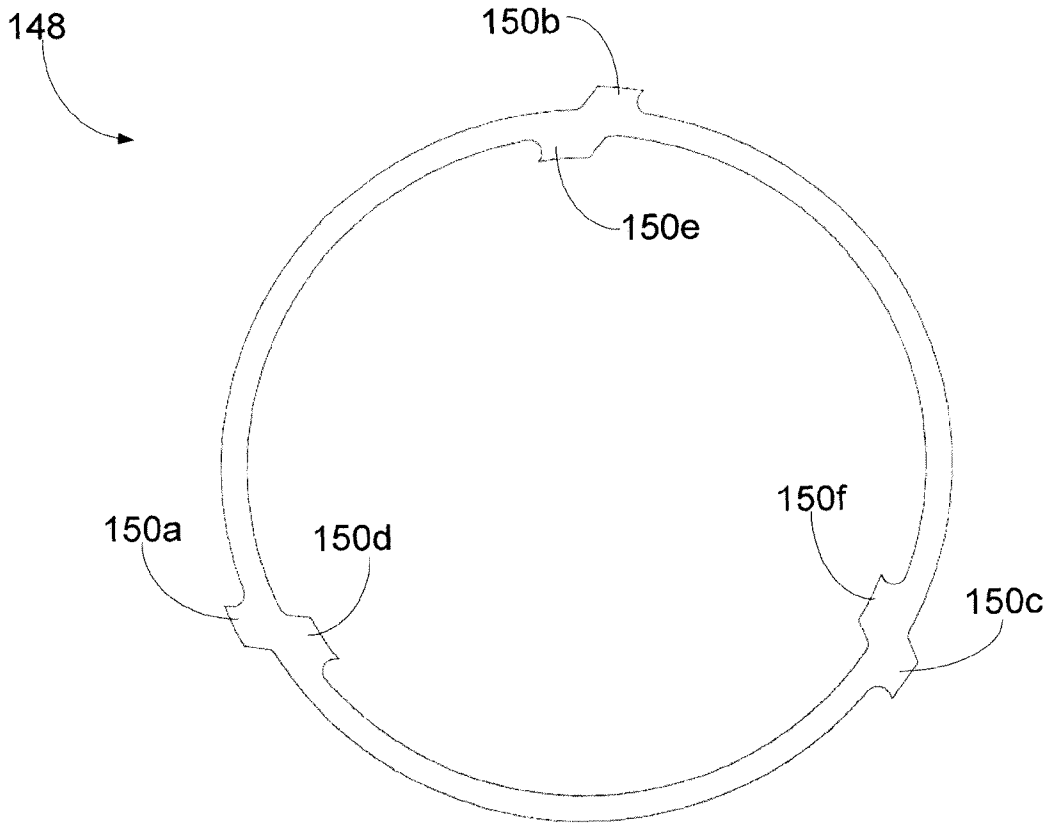

The inner and outer walls 106, 108 and the inlet and outlet baffles 112, 114 are fixedly coupled to each other using any suitable device; for example, one fastener 148 as illustrated in FIG. 9(*c*) can be used to fixedly couple the inner wall 106 and the inlet baffle 112, while another fastener 148 can be used to fixedly couple the inner wall 106 and the outlet baffle 114. Another pair of fasteners 148, having a larger diameter than the fasteners 148 connecting the inner wall 106 and inlet baffle 112 and the inner wall 106 and outlet baffle 114, can be used to similarly fixedly couple the inlet baffle 112 to the outer wall 108 and the outlet baffle 114 to the outer wall 108.

The fastener 148 is substantially circular in shape and includes a series of inner hooks 150*d-f* and outer hooks 150*a-c*. To fixedly couple the inner wall 106 and the inlet baffle 112 together, the fastener 148 is wrapped around the inner wall 106 between the inner wall 106 and the inlet baffle 112 such that the inner hooks 150*d-f* catch on to small loops or other protrusions (not shown) located on the inner wall 106 so that when the inner wall 106 turns, the fastener 148 also turns. The fastener 148 is also placed such the outer hooks 150*a-c* catch on to small loops or other protrusions (not shown) located on the inlet baffle 112 so that when the fastener 148 turns, the inlet baffle 112 also turns. Rotation of the inner wall 108 accordingly also rotates the inlet baffle 112. The inlet baffle 112 and outer wall 108, inner wall 108 and outlet baffle 114, and outlet baffle 114 and outer wall 108 are similarly fixedly coupled together.

Fixedly coupling the inner and outer walls 106, 108 and the inlet and outlet baffles 112, 114 in this way is done so that they rotate in unison when the fractionator 100 is rotating, thus causing the source and destination fluids flowing through the fractionation conduit 110 to experience solid body rotation within the fractionation conduit 110, which in the depicted embodiments is a co-rotating annular gap when the fractionator 100 is operating. If the inner and outer walls 106, 108 were rotating at materially different rates, shear forces that vary with radial distance from the axis of rotation could be introduced to the source and destination fluids, resulting in turbulence, mixing, and improper fractionator operation. Solid body rotation is accordingly beneficial in that it helps establish and maintain stable multilayer flow between the source and destination fluids. In an alternative embodiment, the inner and outer walls 106, 108 and the inlet and outlet baffles 112, 114 are not fixedly coupled together but instead are driven by separate driven trains that are configured to drive the inner and outer walls 106, 108 and the inlet and outlet baffles 112, 114 in unison.

In order to keep mixing and turbulent flow between the destination and source fluids relatively low or to avoid it altogether, for a fraction of the fractionation conduit 110's length, a portion of each of the inlet and outlet baffles 112, 114 extends towards the longitudinal midpoint of the fractionation conduit 110 in a direction parallel to the direction the destination and source fluids flow along the fractionation conduit 110. The portion of the inlet baffle 112 that extends towards the middle of the fractionation conduit 110 is selected to be sufficiently long that the flow of the source and destination fluids is fully developed prior to coming into contact with each other. In the embodiment shown in FIGS. 1 to 8, this portion of the inlet and outlet baffles 112, 114 are cylindrical. The cylindrical portions of both the inlet and outlet baffles 112, 114 are concentric with each other, have identical radii, and each have a longitudinal axis that is collinear with the fractionator 100's axis of rotation. As the destination and source fluids enter the fractionation conduit 110, they transition from travelling transverse to travelling parallel to the axis of rotation; the cylindrical portion of the inlet baffle 112 helps prevent substantial mixing between the destination and source fluids as they make this transition. Similarly, the cylindrical portion of the outlet baffle 114 helps prevent substantial mixing between the destination and source fluids as they exit the fractionation conduit 110. As mentioned above, the centrifugal force that results from the fractionator 100's rotation and from the solid body rotation of the source and destination fluids is responsible for fractionating the target particles. Accordingly, maintaining the stable multilayer flow between the destination and source fluids is beneficial.

Each of the destination and source fluid inlets 116, 118 and outlets 120, 122 circumscribes the fractionation conduit 110, facilitating a relatively even and high fluid flow rate by virtue of allowing 360° access to the fractionation conduit 110. The inlet mounting block 124 surrounds the destination and source fluid inlets 116, 118 and is used to supply the destination and source fluids to the fractionation conduit 110, while the outlet mounting block 126 surrounds the destination and source fluid outlets 120, 122 and is used to channel away the destination and source fluids from the fractionation conduit 110. While allowing the body 102 of the fractionator 100 to rotate, the mounting blocks 124, 126 also fixedly couple together the end faces 104, the baffles 112, 114 and the inner and outer walls 106, 108 of the fractionator 100, thus maintaining structural integrity of the body 102 without requiring use of any additional connecting members that may interfere with the fractionator 100's efficient operation and allowing the fractionator 100 to cause the source and destination fluids to experience solid body rotation.

Perspective views of the inlet and outlet mounting blocks 124, 126 are shown in FIGS. 9(*a*) and (*b*), respectively. The inlet mounting block 124 includes a destination fluid block inlet 140 and a source fluid block inlet 142 that are respectively fluidly coupled to a destination fluid supply conduit 128 and a source fluid supply conduit 130. Each of the destination and source fluid supply conduits 128, 130 is circular in shape and circumscribes the circular opening in the inlet mounting block 124 through which the body 102 of the fractionator 100 is inserted. However, each of the destination and source fluid supply conduits 128, 130 is respectively fluidly coupled to the destination and source fluid inlets 116, 118 of the body 102 via two arcuate openings in the interior of the inlet mounting block 124. When the body 102 is mounted in the inlet mounting block 124, the two arcuate openings that lead to the destination fluid supply conduit 128 and the destination fluid inlet 116 are all coplanar. Consequently, as the body 102 rotates within the inlet mounting block 124, the destination fluid can flow from the destination fluid block inlet 140 to the destination fluid inlet 116 via the arcuate openings in the inlet mounting block 124. Two arcuate openings in the inlet mounting block 124 similarly fluidly couple the source fluid supply conduit 130 to the source fluid inlet 118.

The construction of the outlet mounting block 126 mirrors that of the inlet mounting block 124. Specifically, the outlet mounting block 126 has destination and source fluid exit conduits 132, 134 that lead to destination and source fluid block outlets 144, 146. Arcuate openings in the interior of the outlet mounting block 126 allow the destination and source fluid exit conduits 132, 134 to be fluidly coupled to the destination and source fluid outlets 120, 122 when the fractionator 100 is mounted in the outlet mounting block 126. Consequently, when in operation, the destination and source fluid is able to enter the destination and source fluid block inlets 140, 142; pass through the destination and source fluid supply conduits 128, 130; enter the fractionation conduit 110 through the destination and source fluid inlets 116, 118; flow through the fractionation conduit 110; exit the fractionation conduit 110 through the destination and source fluid outlets 120, 122; and then leave the fractionator 100 through the destination and source fluid block outlets 144, 146 via the destination and source fluid exit conduits 132, 134. Because of the circular shape of the destination and source fluid inlets and outlets 116, 118, 120, 122, fluid flow can occur continuously even while the fractionator 100 is being rotated.

Figure 10:
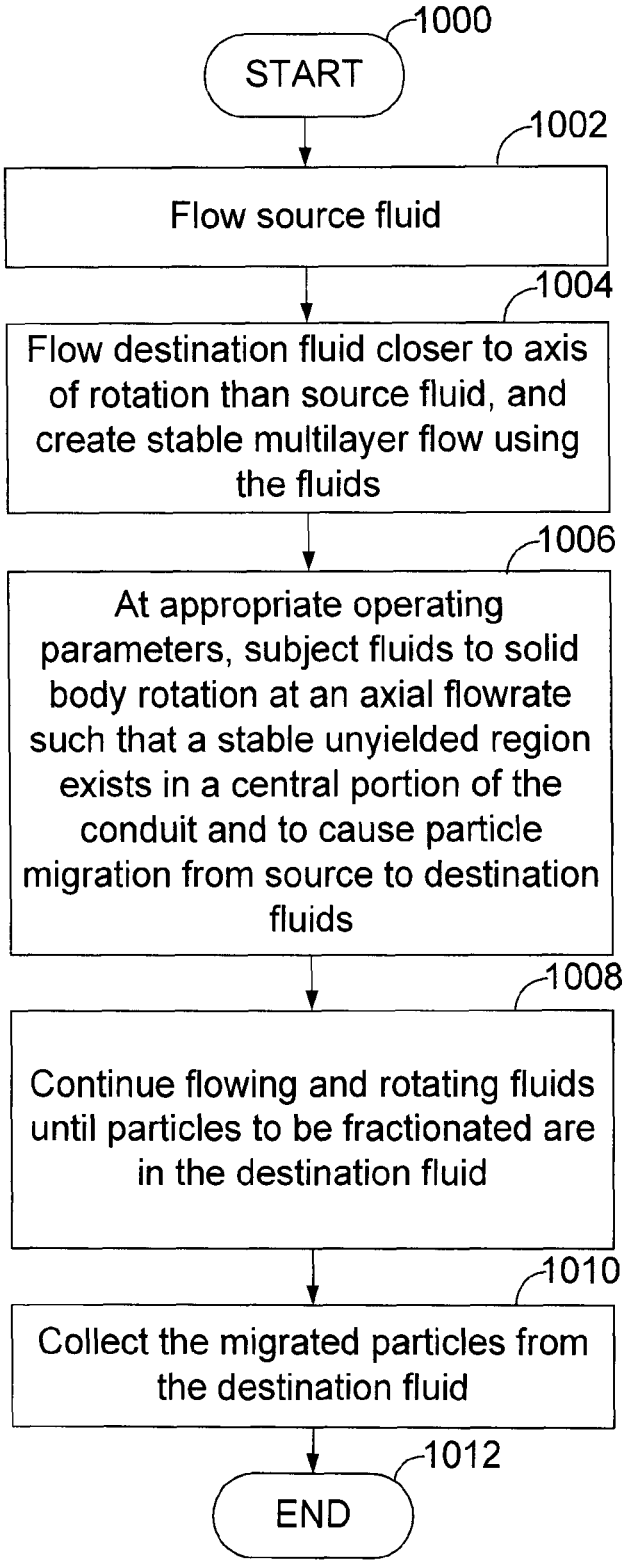
FIG. 10 is a method for fractionating particles, according to another embodiment.

Referring now to FIG. 10, there is a shown a method for fractionating the target particles, according to another embodiment. At block 1000, the method commences and proceeds to block 1002. At block 1002, the source fluid is pumped through the fractionator 100. Simultaneously, at block 1004, the destination fluid is also pumped through the fractionator 100. The destination and source fluids may each be formulated from the same viscoplastic fluid, or alternatively can be formulated using different viscoplastic fluids having different yield stresses. The source and destination fluids are pumped at identical rates to keep the shear forces between the two fluid streams relatively low; such that they contact each other and form a stable multilayer flow (i.e., pumped such that turbulent flow or mixing between the source and destination fluids is substantially prevented); and such that the source fluid is radially closer to the axis of rotation than the destination fluid so that when the fractionator 100 is rotated, the centrifugal force will push the target particles from the source fluid into the destination fluid. When the two fluid streams form the stable multilayer flow, a bulk axial flow composed of the unyielded source and destination fluids moves along a central portion of the fractionation conduit 110, while a relatively thin yielded layer of the source fluid flows adjacent the inner wall 106 and a relatively thin yielded layer of the destination fluid flows adjacent the outer wall 108 in response to the rotation of the inner and outer walls 106, 108.

As the destination and source fluids are being pumped through the fractionator 100, the rod 136 is turned and the fractionator 100 is rotated at block 1006. The fractionation conduit 110 accordingly becomes a co-rotating (by virtue of the rotation of the inner and outer walls 106, 108) annular gap that subjects the source and destination fluids to solid body rotation. The fractionator 100 is rotated at a sufficiently high angular velocity to apply a force against the target particles that equals or exceeds each of the resistive forces that correspond to the fluids' yield stresses. The angular velocity is selected to be sufficiently high such that the target particles cause the viscoplastic fluids to yield. However, the angular velocity is also selected to be sufficiently low such that any other types of particles contained within the source fluid do not cause the viscoplastic fluids to yield; such that the viscoplastic fields do not yield on their own or otherwise change their properties in response to the rotation; and such that the stable multilayer flow is maintained (i.e. the bulk axial flow of the viscoplastic fluids along the central portion of the fractionation conduit 110 continues while any mixing between the source and destination fluids is substantially prevented). More particular operating parameters are discussed below in respect of FIGS. 12(*a*) and (*b*), below. The solid body rotation and the resulting centrifugal force result in the target particles being able to migrate from the source fluid into the destination fluid, but in the non-target particles being trapped in the source fluid. At block 1008, rotation is continued until the target particles have migrated into the destination fluid from the source fluid. The residence time of the target particles in the fractionator 100 can be controlled by adjusting the destination and source fluid flow rate. Once the target particles have migrated to the destination fluid, they can be recovered from the destination fluid once the destination fluid exits the fractionator 100. During particle migration, the source and destination fluids continue to be pumped longitudinally through the fractionator 100, thus allowing fractionation to be performed continuously.

Figure 12A:
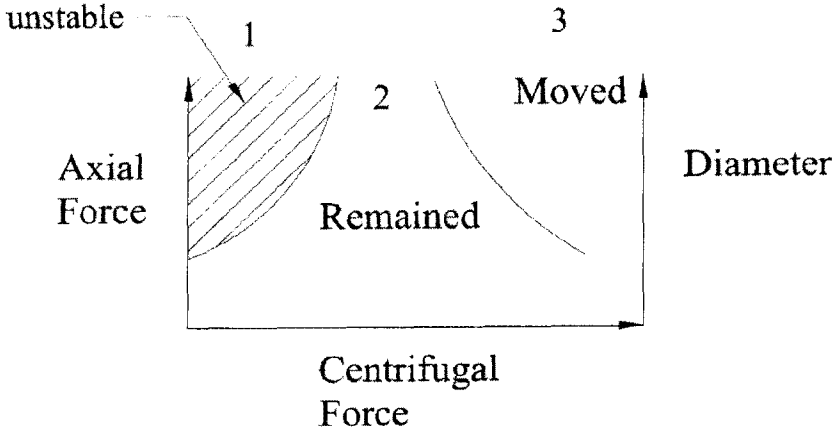
FIGS. 12(*a*) and (*b*) are graphs depicting the relationship between various operating parameters that can be used when performing the method of FIG. 10.
Figure 12B:
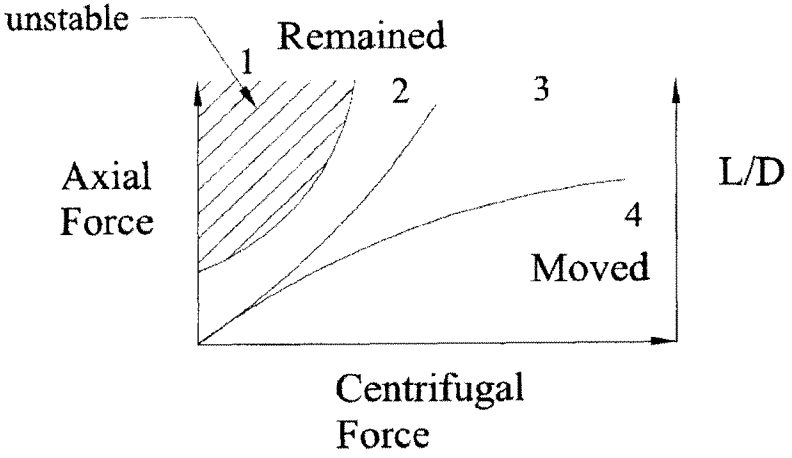

Referring now to FIGS. 12(*a*) and (*b*), there are shown graphs of various operating parameters that can be employed when performing the method of FIG. 10. FIG. 12(*a*) applies to spherical particles, while FIG. 12(*b*) applies to cylindrical particles. In both of FIGS. 12(*a*) and (*b*), one of the vertical axes refers to "axial force," which is directly proportional to the flow rate of the destination and source fluids along the fractionation conduit 110 of the fractionator 100. The other vertical axis in FIG. 12(*a*) is for the diameter of the spherical particles in the viscoplastic fluid, while the other vertical axis in FIG. 12(*b*) is for the ratio of length to diameter of the cylindrical particles in the viscoplastic fluid. The horizontal axes refer to "centrifugal force," which is directly proportional to the angular velocity at which the body 102 of the fractionator 100 rotates about the axis of rotation; i.e., the velocity at which the rod 136 is turned.

In FIG. 12(*a*), region one describes attempting to perform fractionation at relatively high axial forces and relatively low centrifugal forces. This is unstable as it results in mixing between the source and destination fluids, and consequently prevents fractionation from happening. In region two, centrifugal forces are generally higher, and while the source and destination fluids remain stable the centrifugal forces are insufficient to cause the particles to migrate within the viscoplastic fluid. In region three, centrifugal forces are high enough to cause the targeted particles to move.

In FIG. 12(*b*), region one again describes attempting to perform fractionation at relatively high axial forces and relatively low centrifugal forces, which results in instability. When the longitudinal axis of the cylindrical particles is perpendicular to the direction in which the destination and source fluids are flowing, then region two represents those operating parameters that result in the particles not radially migrating within the viscoplastic fluid, while regions three and four represent those operating parameters that result in the particles radially migrating through the viscoplastic fluid as a result of centrifugal force. When the longitudinal axis of the cylindrical particles is parallel to the direction of flow of the destination and source fluids, then regions two and three represent those operating parameters that result in the particles not radially migrating as a result of centrifugal force, while only region four represents those parameters that generate sufficient centrifugal force to cause the particles to radially migrate.

As mentioned above, during fractionation operating parameters are selected such that the target particles migrate radially within the viscoplastic fluid as a result of centrifugal force, but such that none of the other particles do. When dealing with spherical particles, for example, this would mean that the operating parameters are selected such that the target particles are in region 3 of FIG. 12(*a*), whereas all other types of particles are in region 2.

Figure 16:
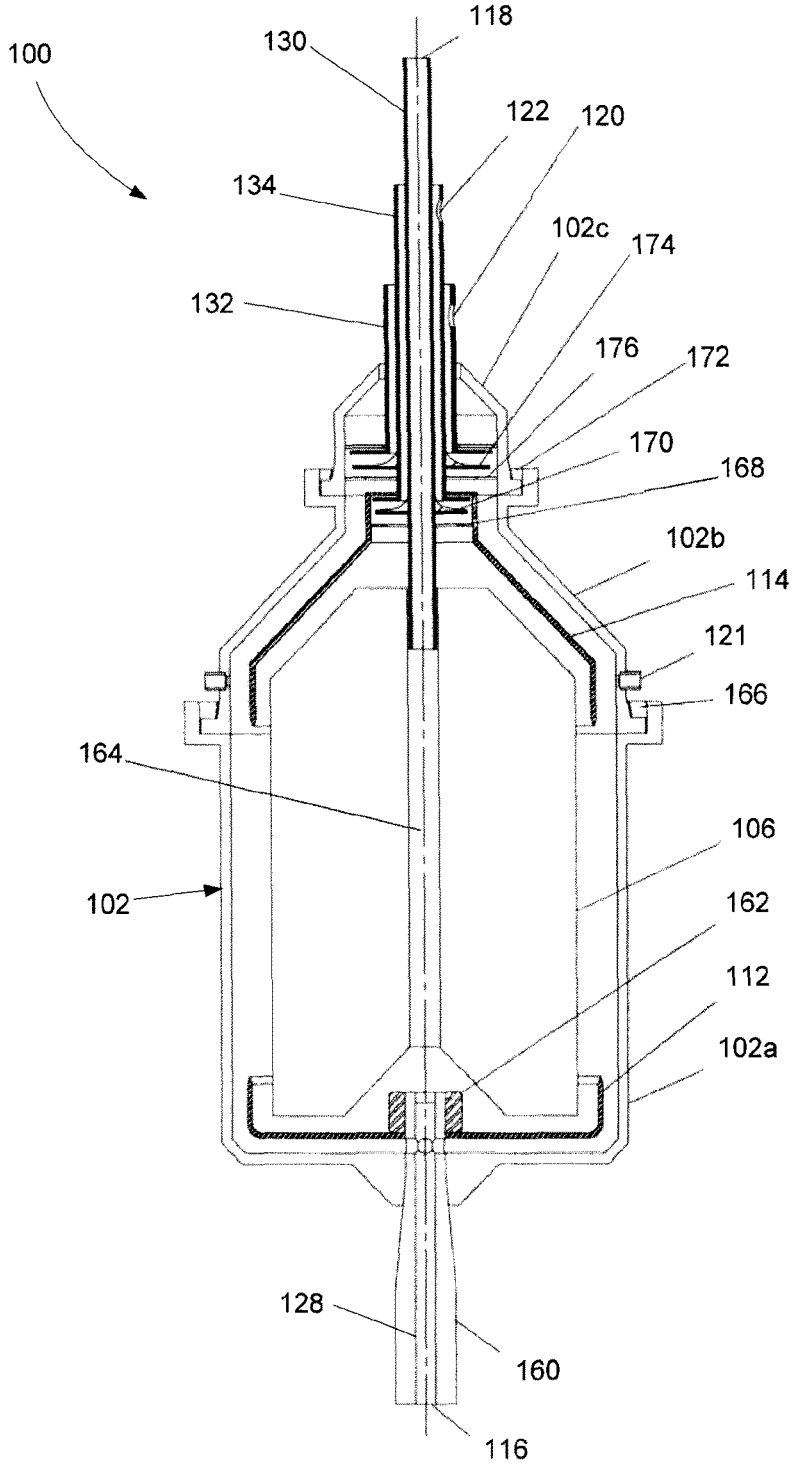
FIGS. 16 and 17 are schematics of an apparatus for fractionating particles, in which the apparatus has two inputs for accepting source and destination fluids, according to two additional embodiments.
Figure 17:
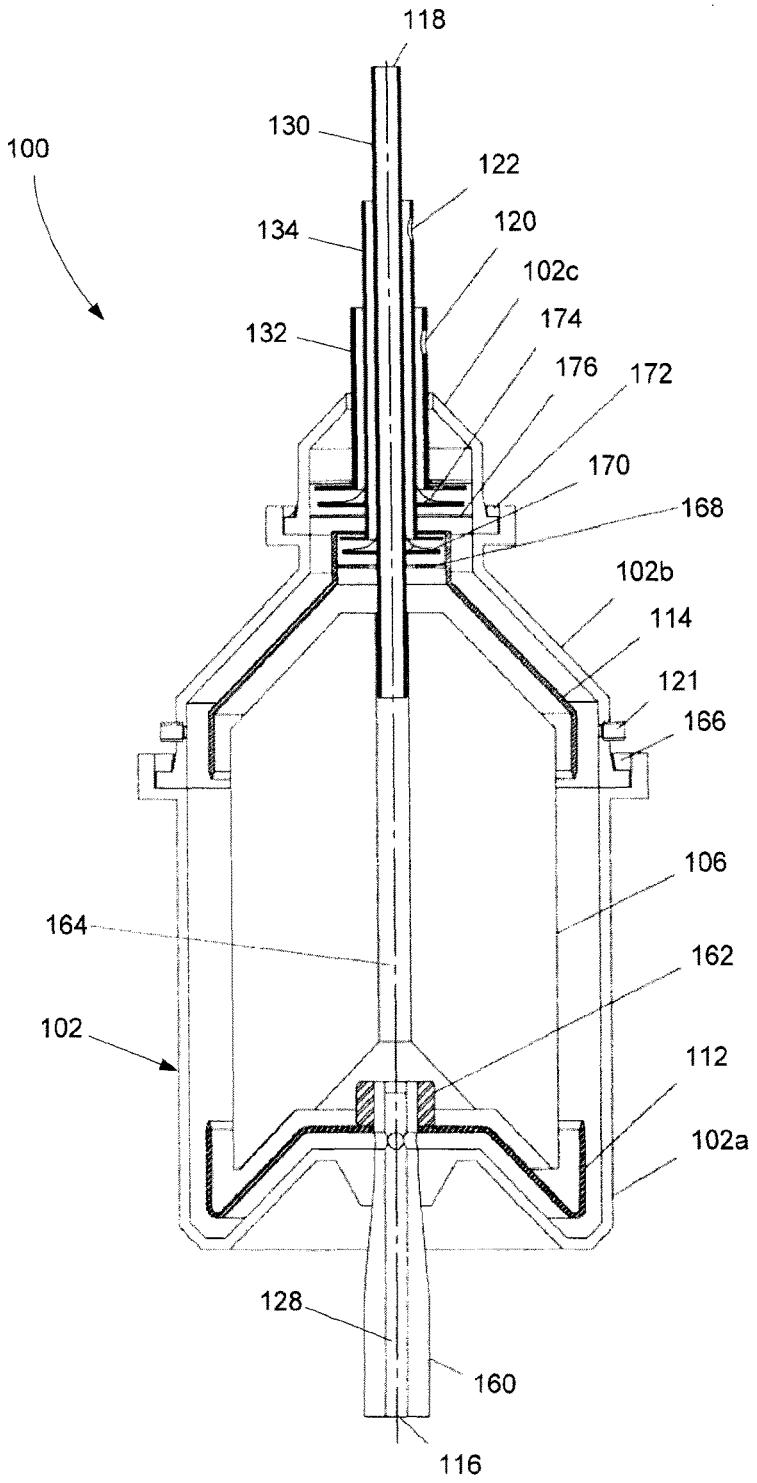

Referring now to FIGS. 16 and 17, there are shown two further embodiments of the fractionator 100 in which the fractionator 100 has two inputs for accepting the source and destination fluids.

Referring in particular to the fractionator 100 shown in FIG. 16, the body 102 of the fractionator 100 is manufactured using a lower bowl 102*a*, an upper bowl 102*b* whose bottom end is secured to the top end of the lower bowl 102*a* using a large ring nut 166, and a pump cover 102*c* whose bottom end is secured to the top end of the upper bowl 102*b*. Extending into the bottom end of the lower bowl 102*a* along the fractionator 100's axis of rotation is a spindle 160 on which the fractionator 100 rotates when in operation. The spindle 160 is secured to the lower bowl 102*a* with a spindle nut 162 that clamps the spindle 160 to the interior of the bottom side of the lower bowl 102*a*. Clamped between the spindle 160 and the spindle nut 162 is a flat end plate, which is part of the inlet baffle 112. The flat end plate divides the fractionation conduit 110 in half and bends upwards at its edge to form a curved cylindrical wall that extends a fraction of the length of the fractionation conduit 110 towards the upper bowl 102*b*. The curved cylindrical wall also forms part of the inlet baffle 112.

The destination fluid supply conduit 128 extends within the spindle 160 along the axis of rotation, into the lower bowl 102*a*, and into the fractionation conduit 110 on the side of the inlet baffle 112's flat end plate nearest to the exterior of the fractionator 100; the destination fluid inlet 116 is accordingly at the end of the spindle 160 that is outside of the body 102. Positioned opposite the spindle 162 and extending through the pump cover 102*c* and into the upper bowl 102*b* along the axis of rotation is the source fluid supply conduit 130. The source fluid supply conduit 130 is positioned to discharge the source fluid into a tubular cavity 164 that extends downwards through the fractionator 100, along the axis of rotation, and that discharges the source fluid directly over the spindle nut 162. The source fluid inlet 118 is accordingly at the end of the source fluid supply conduit 130 that is outside of the body 102.

The top of the outlet baffle 114 is fixedly attached to the exterior of the source fluid exit conduit 134 and is coplanar with the small ring nut 172. The outlet baffle 114 extends along the fractionation conduit 110 and divides the portion of the fractionation conduit 110 between the inner wall 106 and the portion of the outer wall 108 defined by the upper bowl 102*b* in half. Piping that comprises the source fluid supply conduit 130 also extends concentrically within and out the ends of piping that comprises the source fluid exit conduit 134, which itself extends concentrically within and out the ends of piping that comprises the destination fluid exit conduit 132. The source fluid outlet 122 and the destination fluid outlet 120 are slots in portions of the source fluid exit conduit 134 and destination fluid exit conduit 132, respectively, that are outside of the body 102. Located above the large ring nut 166 is a supplementary outlet 121 through which the destination fluid may be discharged instead of through the destination fluid outlet 120. Using the supplementary outlet 121 may be beneficial in that it allows the destination fluid, and the particles that have been fractionated, to be discharged from the fractionator 100 without having to overcome the gradient of the upper bowl 102*b*.

Located along each of the destination and source fluid exit conduits 132,134 is a pump used to respectively pump the destination and source fluids through the fractionator 100.

The pump located along the destination fluid exit conduit 132 is constructed using a first paring disc 170 and a first weir 168, and the pump located along the supply fluid exit conduit 134 is constructed using a second paring disc 176 and a second weir 174. While in the depicted embodiment the pumps are constructed using paring discs, in alternative embodiments (not depicted) the pumps may be constructed using, for example, pito-tubes or another similar device that converts a portion of the fluid's rotational energy into pressure. In other alternative embodiments (not depicted), the fractionator 100 may not include any pumps, and instead the source and destination fluids may be pumped through the fractionator 100 using pumps located outside the fractionator 100.

When in operation, the fractionator 100 of FIG. 16 stands upright on the spindle 160 and is rotated. The inner and outer walls 106,108 and the inlet and outlet baffles 112,114 are all fixedly coupled together and accordingly undergo solid body rotation as the fractionator 100 spins. The destination and source fluid inlets 116,118 are fluidly coupled to destination and source fluid reservoirs (not shown) and the paring discs 170,174 pump the destination and source fluids into the fractionator 100. The destination fluid enters the fractionation conduit 110 on the side of the inlet baffle 112 facing the outer wall 108, and is pumped towards the sides of the body 102 until it flows past the end of the inlet baffle 112.

At the same time, the source fluid is pumped through the source fluid supply conduit 130 and down the tubular cavity 164, and enters the fractionation conduit 110 on the side of the inlet baffle 112 facing the inner wall 106. The source fluid is pumped towards the sides of the body 102 until it flows past the end of the inlet baffle 112 and comes into contact with the destination fluid to form a stable multilayer flow as the fluids flow along the portion of the fractionation conduit 110 between the inlet and outlet baffles 112,114. As with the embodiment of the fractionator 100 discussed above in respect of FIGS. 1 to 9, centrifugal force applied to the particles when the source and destination fluids form a stable multilayer flow causes the particles to move from the source fluid to the destination fluid. The fluids eventually reach the outlet baffle 114 where the destination fluid, which contains the fractionated particles, is pumped to the side of the outlet baffle 114 facing the outer wall 108 and the source fluid is pumped to the side of the outlet baffle 114 facing the inner wall 106. The fluids are subsequently pumped into and through the source and destination fluid exit conduits 134, 132, and out the source and destination fluid outlets 122,120.

The embodiment of the fractionator 100 shown in FIG. 17 is identical to the embodiment of the fractionator 100 shown in FIG. 16, with the exception of the shape of the bottom of the inner and outer walls 106,108 and of the inlet baffle 112. The flat end plate that forms part of the inlet baffle 112 in the fractionator 100 of FIG. 16 is replaced with an end plate that is bent away from the interior of the body 102 and in a direction non-orthogonal relative to the axis of rotation. The inner and outer walls 106,108 are correspondingly bent. Bending the walls 106,108 and inlet baffle 112 in this way helps to lower the center of gravity of the fractionator 100, making it more stable when in operation.

Figure 18:
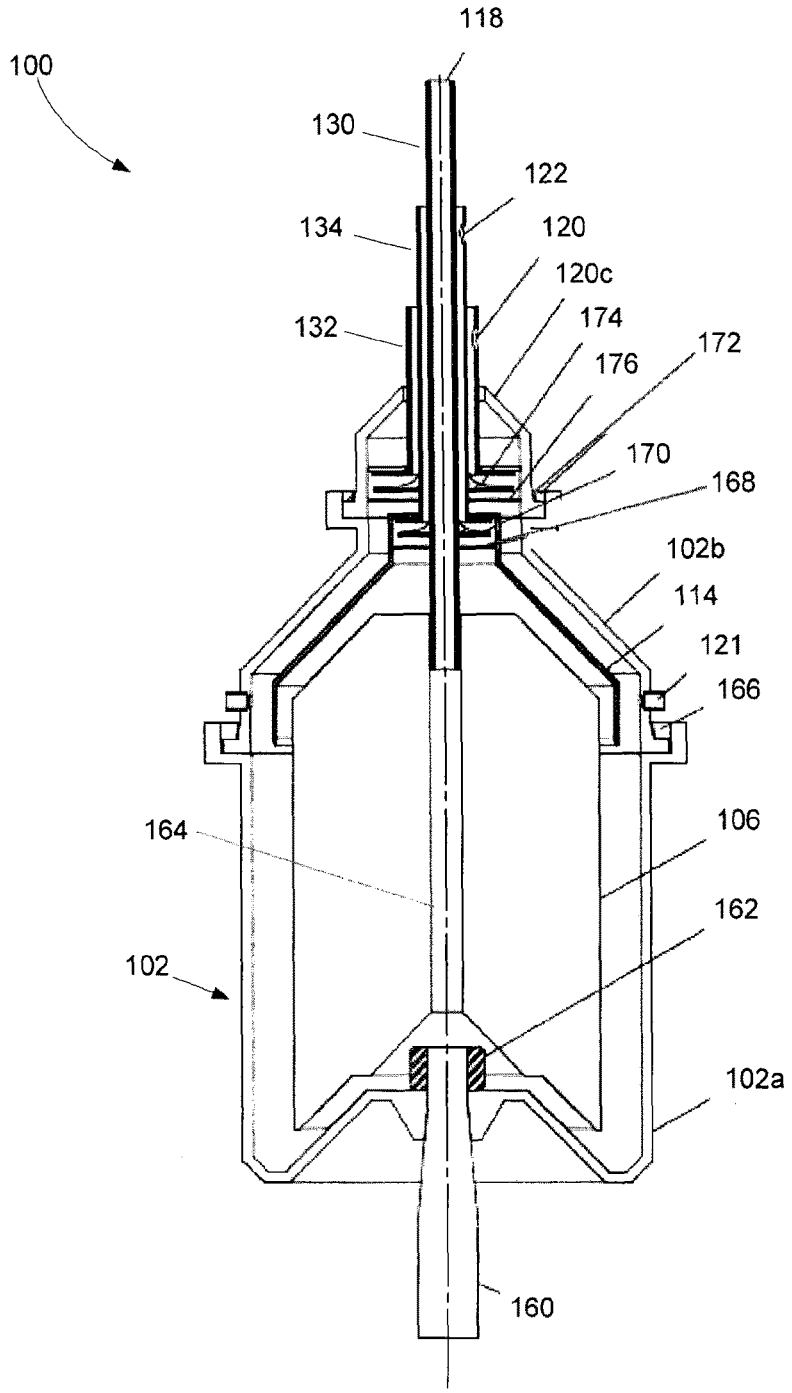
FIG. 18 is a schematic of an apparatus for fractionating particles, in which the apparatus has a single input for accepting both the source and destination fluids, according to another embodiment.

Referring now to FIG. 18, there is shown an embodiment of the fractionator 100 identical to that of FIG. 17 with the exception that the fractionator 100 of FIG. 18 has no inlet baffle 112, no destination fluid inlet 116, and no destination fluid supply conduit 128. Instead, the fractionator 100 of FIG. 18 fractionates by using centrifugal force to move particles radially outwards in the source fluid as the source fluid moves through the fractionator 100 towards the outlet baffle 114 without moving them into a separate stream of destination fluid. By the time the source fluid reaches the outlet baffle 114, a percentage of the particles have been moved outwards sufficiently towards the outer wall 108 by centrifugal force such that when the stream of source fluid reaches the outlet baffle 114 these particles are between the outlet baffle 114 and the outer wall 108. When the source fluid reaches the outlet baffle 114 and is separated into two fractions, the fluid between the outlet baffle 114 and the inner wall 106 remains the source fluid, while the fluid between the outlet baffle 114 and the outer wall 106 becomes the destination fluid. Both the source and destination fluids then exit the fractionator 100 via the source and destination fluid exit conduits 134,132 and outlets 122,120, as described above in respect of other embodiments of the fractionator 100 above. When using the fractionator 100 shown in FIG. 18 in this way, the source fluid does not form a stable multilayer flow with the destination fluid as there is no destination fluid distinct from the source fluid between the inlet and outlet baffles 112,114; however, the fractionator 100 is operated such that the source fluid forms a laminar spiral Poiseuille flow.

The foregoing describes exemplary embodiments only. Alternative embodiments, which are not depicted, are possible. For example, in one alternative embodiment, fractionation can be performed by pumping both the source and destination fluids into the source fluid supply conduit 130 of the fractionator 100 shown in FIG. 18, if the source and destination fluids are selected to have sufficiently different densities that while flowing to the outlet baffle 114 they separate from each other and form a stable multilayer flow without need for the inlet baffle 112. Furthermore, in another alternative embodiment, the destination fluid need not be viscoplastic. Instead, only the source fluid is viscoplastic, and the destination fluid carries fractionated particles to the outlet baffle 114.

As another example, while the embodiments of the fractionator 100 shown above use baffles 112,114 that divide the fractionation conduit 110 in half, in some alternative embodiments the baffles 112,114 do not divide the fractionation conduit 110 in half. In some of these embodiments, for example, the baffles 112,114 may or may not be symmetric about an axis orthogonal to the axis of rotation; they may or may not be parallel to the inner and outer walls 106,108; they may or may not have slopes of identical magnitudes; and they may or may not be linear. For example, in one alternative embodiment, the baffles 112,114 may be frustoconical in that they slope inwards towards the center of the fractionator 100. The outlet baffle 114 may take any suitable shape so long as it is shaped to separate fluid flowing along the fractionation conduit into two fractions, which are referred to in the foregoing embodiments as the source and destination fluids. The inlet baffle 112 may take any suitable shape so long as it is shaped such that the source fluid and the destination fluid pumped into the fractionation conduit 110 on either side of the inlet baffle 112 comprise a stable multilayer flow when between the inlet and outlet baffles 112,114 and when both the source and destination fluids are viscoplastic.

Determining Axial and Centrifugal Flowrates

The following discussion provides a basis for which particular axial and centrifugal forces, and accordingly particular axial and centrifugal flowrates, as they apply to the fractionator 100 can be determined. The following discussion provides one example of how to determine operating conditions that result in the source and destination fluids being in stable multilayer flow. However, in alternative embodiments the fractionator 100 may be operated in conditions that vary from those determined exactly in accordance with the following discussion while nonetheless maintaining stable multilayer flow (i.e. multilayer flow that is maintained at least until disturbed from equilibrium).

Defining the Size of the Plug Versus Flowrate

The constitutive model that is considered is that of a Bingham fluid. These are characterized by a density $\hat{\rho}$, a yield stress $\hat{\tau}_y$ and a plastic viscosity $\hat{\mu}_p$. The geometry of the spiral Poiseuille flow is a channel formed in the annular gap between two concentric cylinders of radii $\hat{R}_1$ and $\hat{R}_2$ that rotate with the same angular speed $\hat{\omega}$; in the fractionator 100 discussed above, the annular gap corresponds to the fractionation conduit 110, the concentric cylinder of radius $\hat{R}_2$ corresponds to the outer wall 108, and the concentric cylinder of radius $\hat{R}_1$ corresponds to the inner wall 106. There is an imposed dimensional pressure gradient in the $\hat{z}$-direction $\hat{p}=-G\hat{z}$. The Navier-Stokes equations are nondimensionalized using a length scale of $\hat{d}=\hat{R}_2-\hat{R}_1$, a velocity $\hat{U}_0$ and time scale $\hat{t}_0$ of $$\hat{U}_0 = \frac{\hat{d}^2 G}{2\hat{\mu}_p} \quad \hat{t}_0 = \frac{\hat{\rho}\hat{d}^2}{\hat{\mu}_p}$$

and a pressure-stress scale of $\hat{\mu}_p\hat{U}_0/\hat{d}$. Using these scalings, and omiting the hat notation for dimensionless variables, the scaled constitutive equations for the fluid are $$\tau_{ij} = \left(1 + \frac{B}{\dot{\gamma}}\right)\dot{\gamma}_{ij} \Leftrightarrow \tau > B \tag{1}$$

$$\dot{\gamma} = 0 \Leftrightarrow \tau \le B \tag{2}$$

where $\dot{\gamma}$ and $\tau$ are the second invariants of the rate of strain and deviatoric stress tensors, respectively. These are defined by $$\dot{\gamma} = \left[\frac{1}{2}\dot{\gamma}_{ij}\dot{\gamma}_{ij}\right]^{\frac{1}{2}}, \tau = \left[\frac{1}{2}\tau_{ij}\tau_{ij}\right]^{\frac{1}{2}} \tag{3}$$

where $\dot{\gamma}_{ij}=u_{ij}+u_{ji}$. With these, it is determined that this flow is characterized by five dimensionless groups, the axial and tangential Reynolds numbers, $Re_z$ and $Re_\theta$, the Bingham number B, the ratio of the swirl and axial velocities, $\omega$, and the ratio of the radii of the two cylinders, $\eta$:

$$\mathrm{Re}_z = \frac{\hat{\rho}\hat{U}_0\hat{d}}{\hat{\mu}_p}, \mathrm{Re}_\theta = \frac{\hat{\rho}\hat{\omega}R_2\hat{d}}{\hat{\mu}_p}, B = \frac{\hat{\tau}_y\hat{d}}{\hat{\mu}_p\hat{U}_0} \quad \omega = \frac{\mathrm{Re}_\theta}{R_z R_2} \quad \eta = \frac{\hat{R}_1}{\hat{R}_2}. \tag{4}$$

If $$r = \frac{\hat{r}}{\hat{d}} r \in \left[\frac{\eta}{1-\eta}, \frac{1}{1-\eta}\right] \tag{5}$$

then the equations of motion reduce to $$u_t + Re_z(u\cdot\nabla)u = -\nabla p + \nabla\tau \tag{6}$$

$$\nabla\cdot u = 0 \tag{7}$$

where u is the velocity, p the pressure and $\tau$ the deviatoric stress tensor.

Figure 13:
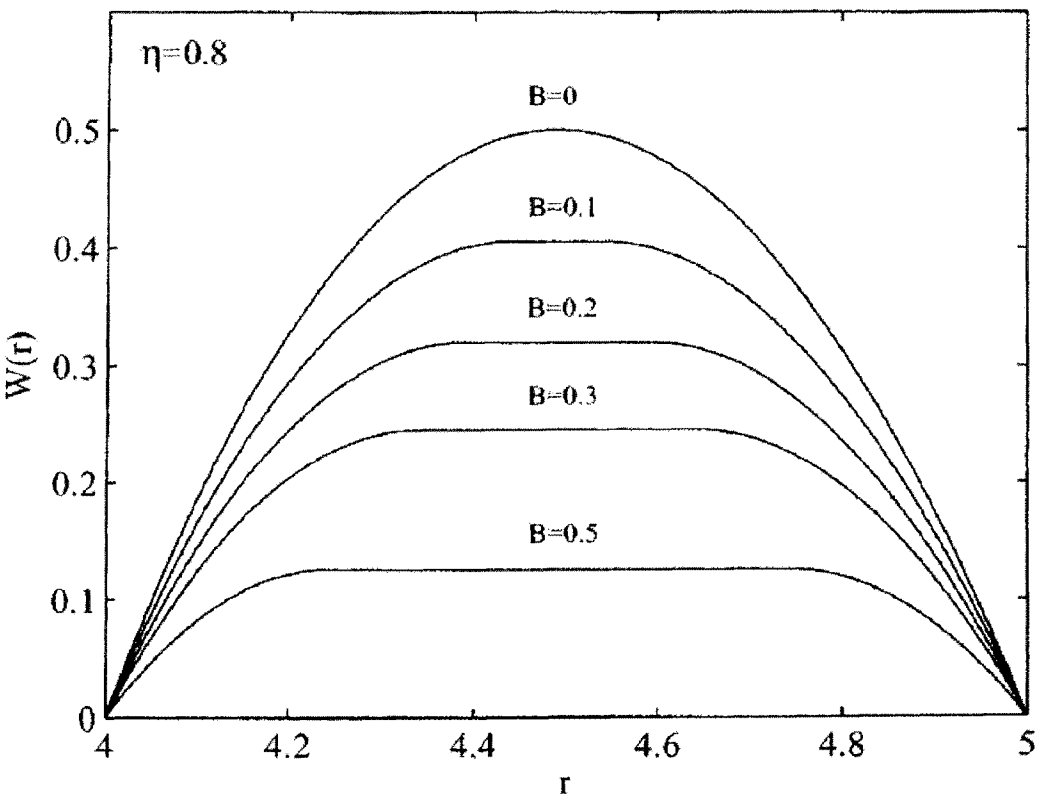
FIG. 13 is a graph showing representative examples of axial velocity W(r) of a viscoplastic fluid in which the particles are embedded and which flows through the apparatus of FIG. 1 for various Bingham numbers at $\eta$=0.8.

Finally, a steady solution of the form $(P,U(r,\theta,z))=[P(r,\theta), 0,r\omega,W(r)]$ exists where W(r) may be determined from the general solution $$\tau_{rz} = -r + \frac{C}{r} \tag{8}$$

using the constitutive equation for a Bingham fluid as well as the no-slip conditions. Representative velocity profiles are given in FIG. 13 as a function of B. The steady, fully-developed spiral Poiseuille flow consists of an unyielded region in the center of the channel, for finite B, bounded by two yielded regions. The position of the yield surfaces is found as part of the solution methodology and is dependent only on B; the swirl component does not affect the position of the plug. The size of the plug H is calculated by applying the balance of shear forces and pressure forces on the boundaries of the plug zone and is given by $$H = \frac{\hat{\tau}_y\hat{d}}{\hat{\mu}_p\hat{U}_0} \tag{9}$$

This equation demonstrates the unique relationship between the yield stress, axial velocity and plug size.

Defining the Bounds for Operation

The fractionator 100 operates under laminar flow and the operating conditions are set such that the flow conditions are such that the fluid is stable to small disturbances. Here the classical problem of linear stability is considered, by perturbing the steady flow (P,U), as described above, with an infinitesimally small disturbance on the flow field (p',u') and plug size H'. If $$u=U+\epsilon u' p=P+\epsilon p' h=H+\epsilon h' \tag{10}$$

where $\epsilon \ll 1$, the equations of motion, i.e. Equations 6-7 reduce to $$u'_t + \mathrm{Re}_z\left(\frac{V}{r}\frac{\partial u'}{\partial\theta} + W\frac{\partial u'}{\partial z} - \frac{2V}{r}v'\right) = -\frac{\partial p'}{\partial r} + \left\{\nabla^2 u' - \frac{2}{r^2}\frac{\partial v'}{\partial\theta} - \frac{u'}{r^2}\right\} + B\left\{\frac{1}{r}\frac{\partial}{\partial r}\left(\frac{r\dot{\gamma}_{rr}}{\dot{\gamma}}\right) - \frac{\dot{\gamma}_{\theta\theta}}{r\dot{\gamma}} + \frac{1}{r}\frac{\partial}{\partial\theta}\left(\frac{\dot{\gamma}_{r\theta}}{\dot{\gamma}}\right)\right\} \tag{11}$$

$$u'_t + \mathrm{Re}_z\left(\frac{V}{r}\frac{\partial u'}{\partial\theta} + W\frac{\partial u'}{\partial z} - \frac{2V}{r}v'\right) = -\frac{\partial p'}{\partial r} + \left\{\nabla^2 u' - \frac{2}{r^2}\frac{\partial v'}{\partial\theta} - \frac{u'}{r^2}\right\} + B\left\{\frac{1}{r}\frac{\partial}{\partial r}\left(\frac{r\dot{\gamma}_{rr}}{\dot{\gamma}}\right) - \frac{\dot{\gamma}_{\theta\theta}}{r\dot{\gamma}} + \frac{1}{r}\frac{\partial}{\partial\theta}\left(\frac{\dot{\gamma}_{r\theta}}{\dot{\gamma}}\right)\right\} \tag{12}$$

$$w'_t + \mathrm{Re}_z\left(u'\frac{\partial W}{\partial r} + \frac{V}{r}\frac{\partial w'}{\partial\theta} + W\frac{\partial w'}{\partial z}\right) = -\frac{\partial p'}{\partial z} + \{\nabla^2 w'\} + B\left\{\frac{1}{r}\frac{\partial}{\partial\theta}\left(\frac{\dot{\gamma}_{z\theta}}{\dot{\gamma}}\right) + \frac{\partial}{\partial z}\left(\frac{\dot{\gamma}_{zz}}{\dot{\gamma}}\right)\right\} \tag{13}$$

when terms smaller than $O(\epsilon^2)$ are eliminated. In the limit when B=0, the disturbance equations reduce to that of the Newtonian case. For B>0, as discussed previously, a plug exists in the central portion of the annulus.

To derive the eigenvalue problem it is assumed that the solution can be represented in terms of axi-symmetric normal modes of the form $$(u',v',w',p',h')=(u(r),v(r),w(r),p(r),h)\exp(i\alpha z+\lambda t) \tag{14}$$

where $\alpha$ is the wave number and $\lambda=\lambda_r+i\lambda_i$ is the complex wave speed. Denoting $$D \equiv \frac{d}{dr} \quad L = D^2 + \frac{D}{r} - \frac{1}{r^2} - \alpha^2 \tag{15}$$

the linearized equations for the normal modes are found by substituting equation 14 into equations 11-13. After some algebraic manipulation the normal mode equations reduce to $$-\mathrm{Re}_z\left(uDV + \frac{uV}{r}\right) + D^2 v + \frac{Dv}{r} - \alpha^2 v - \frac{v}{r^2} - Wi\alpha \mathrm{Re}_z v + B\left[-\frac{\alpha^2 v}{\dot{\gamma}} + \frac{1}{r^2}\frac{\partial}{\partial r}\left(r^2 \frac{\dot{\gamma}_{r\theta}}{\dot{\gamma}}\right)\right] = \lambda v \tag{16}$$

$$L^2 u - \mathrm{Re}_z W\alpha i L u + \alpha i \mathrm{Re}_z D^2 W u - \alpha i D W \mathrm{Re}_z \frac{u}{r} - B\phi_r - \frac{2\mathrm{Re}_z V \alpha^2}{r} v = \lambda L u \tag{17}$$

If x=(u,v), these equations may be written as $$Ax=\lambda Bx \tag{18}$$

where $$A=A_V+Re_z A_I+BA_Y, \tag{19}$$

respectively denoting the viscous, inertial and yield stress parts of A. These operators are defined by $$A_V = \begin{pmatrix} L^2 & 0 \\ 0 & L \end{pmatrix}, A_I = \alpha i \begin{pmatrix} D^2 W - \frac{DW}{r} - WL & -2\alpha^2\left(\frac{V}{r}\right) \\ -DV + \frac{V}{r} & -W\alpha i \end{pmatrix},$$

$$A_Y = \begin{pmatrix} \phi_r & 0 \\ 0 & \phi_\theta \end{pmatrix}, B = \begin{pmatrix} L & 0 \\ 0 & 1 \end{pmatrix},$$

The boundary conditions at the inner and outer walls 106,108 are $$u=Du=v=0 \tag{20}$$

and at the yield surface $$u=Du=v=0. \tag{21}$$

The Dirichlet conditions come from consideration of the linear momentum of the plug region. The term Du is formed through the linearization of the condition $\dot{\lambda}_{ij}(U+u')=0$ at the perturbed yield surface position onto the unperturbed yield surface position. Note that the problem defined above is posed over the yield portion of the fractionation conduit 110 $r\epsilon[\eta/(1-\eta),1/(1-\eta)]$. The linear stability problem in the two yielded regions decouple to form two independent and equivalent problems.

Figure 14:
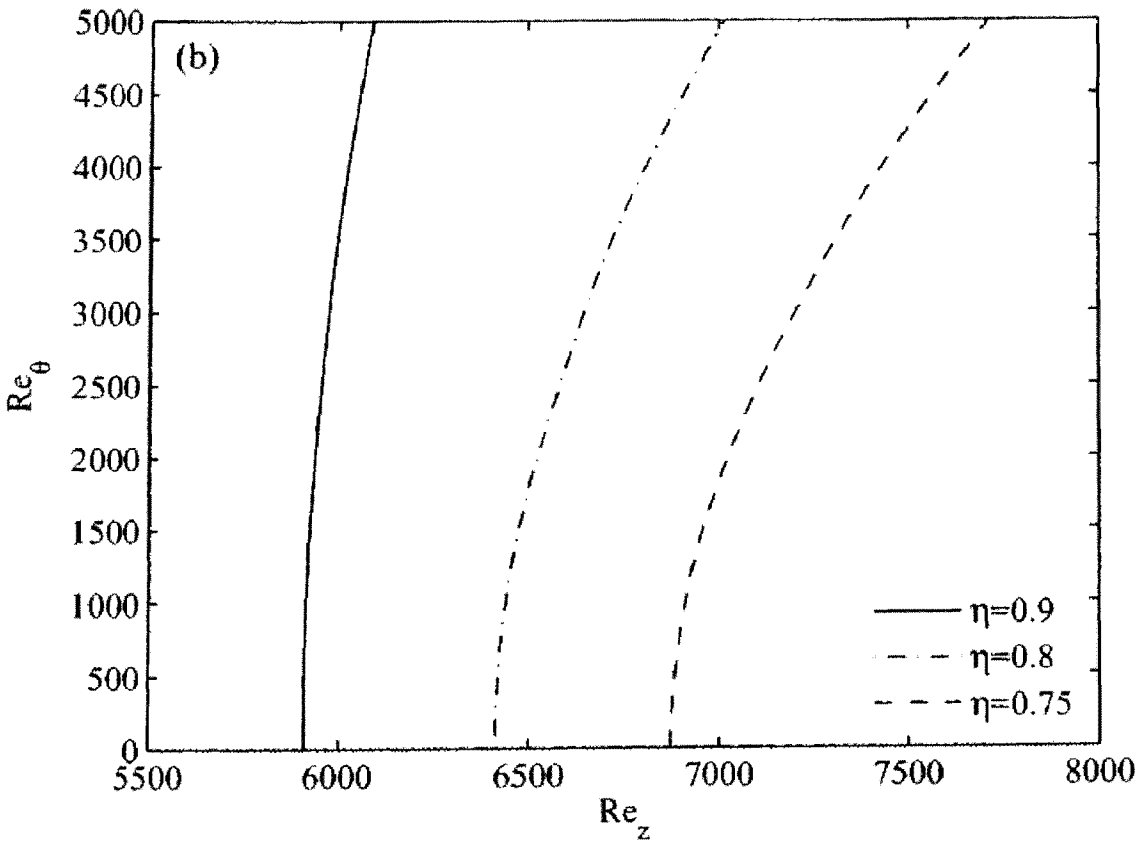
FIG. 14 shows an estimate of the margin of stability between axial flowrate and rotational rate of the apparatus of FIG. 1 for different gap sizes of a fractionation conduit through which the viscoplastic fluid flows and which comprises part of the apparatus.

The system of equation 18 has been solved using a Chebyshev discretization. For fixed ($\mathrm{Re}_z$,$\mathrm{Re}_\theta$,B,η,α) equation 18 is solved for its eigenvalues and eigenfunctions, and the eigenvalue with maximal real part, $\lambda_{R,max}(\alpha)$ is taken. At each ($\mathrm{Re}_z$,$\mathrm{Re}_\theta$,B,η), an inner iteration calculates the wavenumber $\alpha_{max}$ for which $\lambda_{R,max}$ is largest. For the outer iteration, $\mathrm{Re}_z$ is varied until the point in which $\lambda_{r,max}(\alpha)=0$ is found. The margin of stability is shown in FIG. 14 in which the system stabilizes with increasing rotational rates. This figure should be interpreted as any operating conditions to the right of line, at a defined gap size, should be considered unstable leading to transition to turbulence; any operating point to the left has the potential to be under laminar flow conditions. The margin of stability is displayed for the most sensitive case, i.e. when B→0, as a function of gap size. The region of stability increases with increasing yield stress.

The Critical Force Resulting in Motion

Figure 15A:
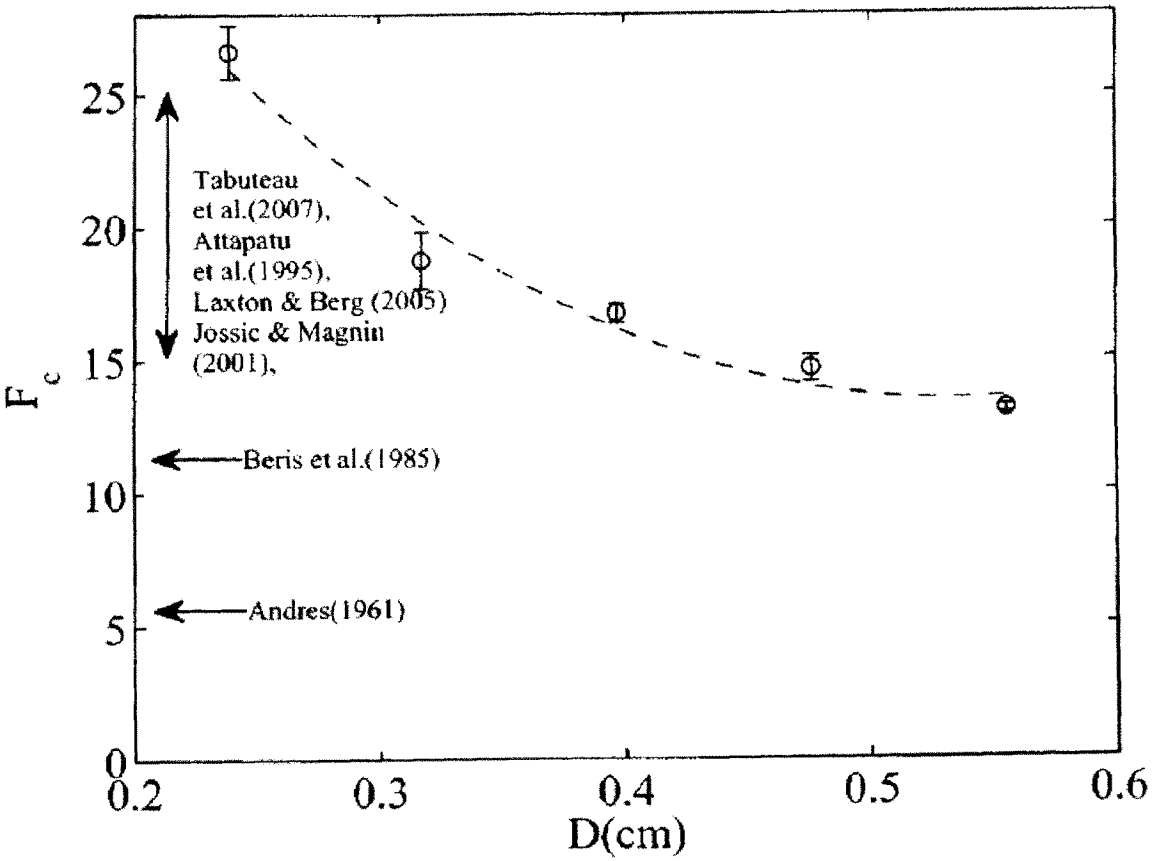
FIG. 15(*a*) shows an estimate of the critical force required to initiate motion for stainless steel spheres contained in the viscoplastic fluid with diameters in the range 2.4 mm≤D≤5.6 mm, and FIG. 15(*b*) shows a measurement of the critical force ratio $F_c$ to cause motion in isolated cylinders of various aspect ratios.
Figure 15B:
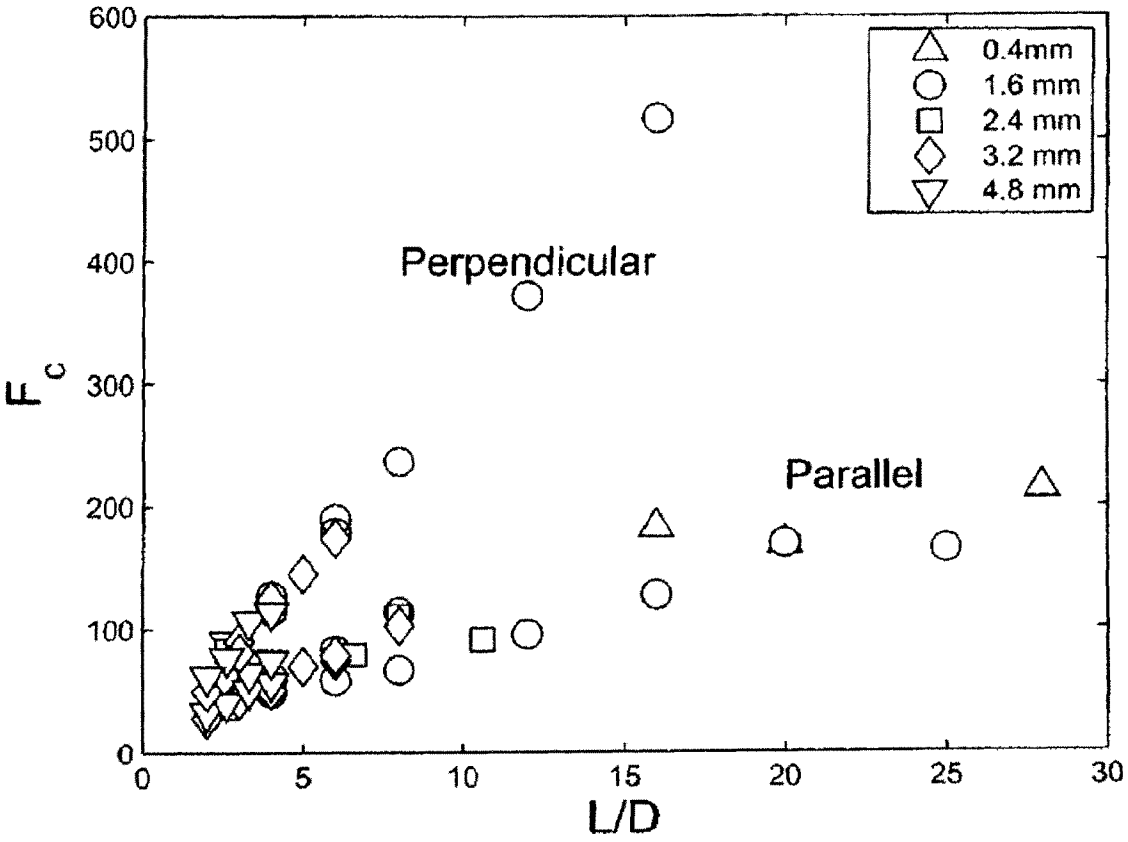

To demonstrate the principle, the force resulting in the initiation of motion of a particle in a yield stress fluid under the action of a centrifugal force is discussed. Two different classes of particles are demonstrated i.e. spheres and rods, in two different orientations relative to the applied centrifugal force. There is no axial flow in this case. The particle is suspended in a yield stress fluid and subjected to a centrifugal force at a radial distance R from the axis of rotation at a fixed angular velocity ω. At the end of the experiment, the position of the sphere was inspected and if unchanged (to within a prescribed tolerance), the test was repeated by increasing the speed of the centrifuge. The procedure continued until motion was induced. With this the force ratio to induce motion was estimated using the following expression $$F_c = \frac{\Delta\rho V R \omega^2}{\tau_y D^2} \tag{22}$$

where V is the volume of the particle and D is the diameter. The results are given in FIG. 15. Two sets of data are given in FIG. 15: for cylinders oriented parallel to the direction of the force and cylinders oriented perpendicularly to the direction of the applied centrifugal field.

In an alternative embodiment (not depicted), the operating parameters can be selected such that both target and non-target particles radially move, but at different rates, as a result of centrifugal force. By knowing the rate of movement and controlling the residence time of the particles within the fractionator 100, fractionation can be performed.

Figure 11:
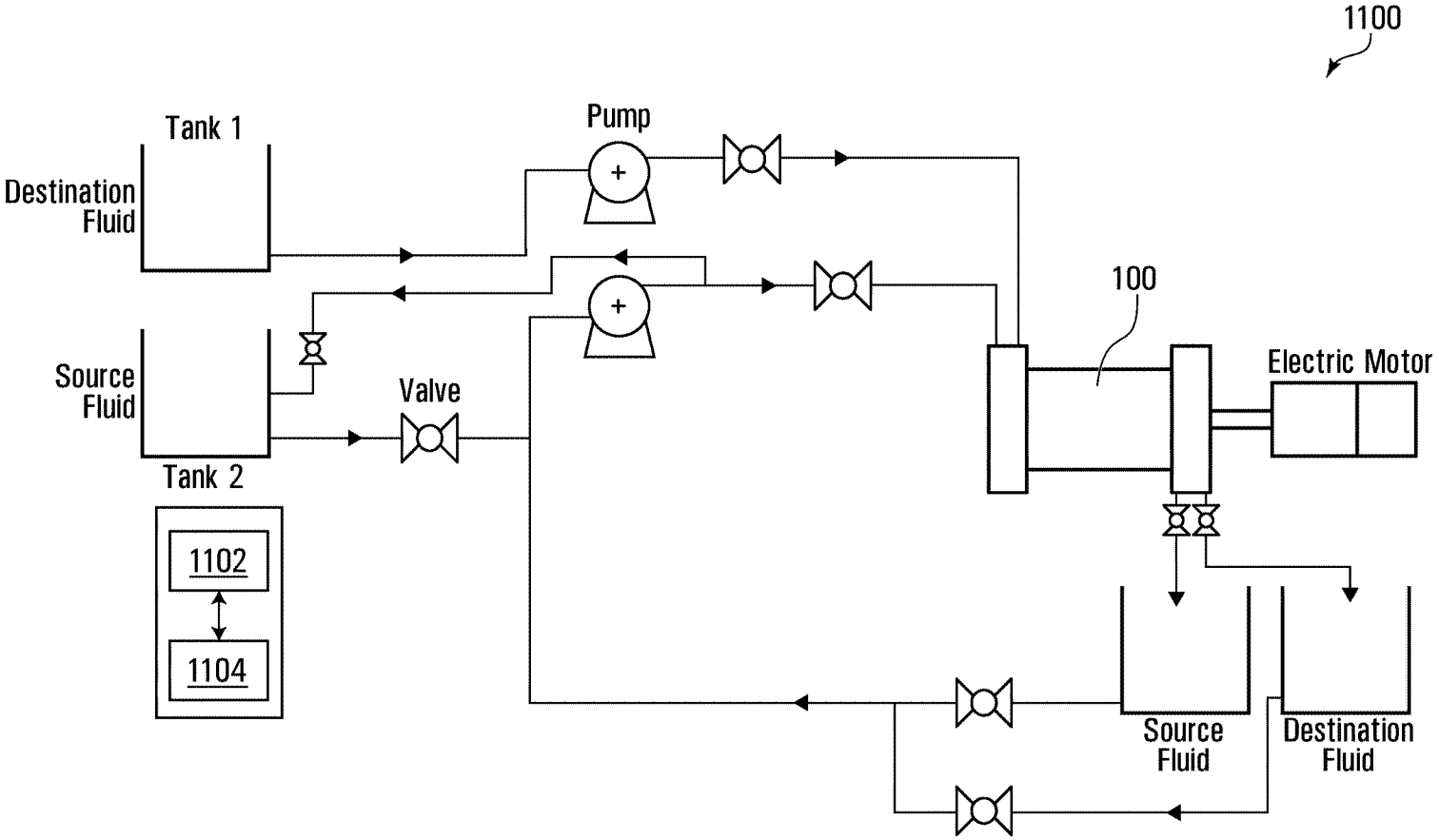
FIG. 11 is a schematic of a system for fractionating particles, according to another embodiment.

Referring now to FIG. 11, there is shown a system 1100, which includes the fractionator 100 of FIGS. 1 to 8, and which can be used for fractionating particles. The system 1100 includes two tanks, labelled Tank 1 and Tank 2, which are respectively used to contain the destination and source fluids. Two rotary screw pumps, which are fluidly coupled to Tanks 1 and 2, pump the destination and source fluids through valves and into the fractionator 100. An electric motor is used to rotate the fractionator 100; a suitable electric motor is, for example, a NEMA 56 base mount AC motor. Flow meters (not shown) are present in the system 1100 to ensure that the destination and source fluids are being pumped at identical rates. After exiting the fractionator 100 and passing through a pair of valves, the source and destination fluids are deposited into Tanks 3 and 4, respectively. Both Tanks 3 and 4 are coupled via another valve and a return line back to Tank 2 to complete a closed loop system. The target particles can then be retrieved from Tank 4.

The return line may be used, for example, when fractionating different types of target particles contained within the same source fluid. For example, prior to any fractionation the source fluid may contain three different types of particles. On a first pass through the system 1100, the system 1100 can be operated such that the first type of particles are fractionated and end up in Tank 4 where they are collected, while the second and third types of particles end up in Tank 3. The return line can be used to send the contents of Tank 3 through the system 1100 a second time with the system 1100 functioning under different operating parameters that are used to separate the second and third types of particles.

On this second pass through the system 1100, the second type of particles ends up in Tank 4, while the third type of particles is sent again to Tank 3. In alternative embodiments, the return line is not present.

In an alternative embodiment (not depicted), the source and destination fluids do not enter the fractionation conduit 110 by flowing in a radial direction across the outer wall 108, but instead the fluid inlet and outlet are in the opposing end faces 104 and the source and destination fluids enter the fractionation conduit 110 by flowing longitudinally across the end faces 104. In this alternative embodiment, the inlet and outlet mounting blocks 124, 126 can be expanded to also cover the end faces 104 and deliver the source and destination fluids into and out of the fractionation conduit 110.

The foregoing embodiments discussed fractionation of target particles by causing the target particles to migrate from the source to the destination fluids. In an alternative embodiment in which the source fluid contains two types of particles, both types of particles may act as target particles, since by causing one type of particles to migrate into the destination fluid both types of particles can be collected after fractionation completes: the type of particles that migrated from the destination fluid, and the other type of particles from the source fluid.

The system 1100 may be automated using any suitable type of controller 1102, such as a programmable logic controller, microprocessor, microcontroller, application specific integrated circuit, field programmable gate array, or the like. A method for fractioning the particles using the system 1100, which can be any of the foregoing embodiments, can be encoded on to a memory 1104 communicatively coupled to the controller 1102. The memory may be any suitable type of semiconductor or disc based memory, such as flash RAM, ROM, hard disk drives, CD-ROMs, and DVD-ROMs, and may be non-transitory.

FIG. 10 is a flowchart of an exemplary method. Some of the blocks illustrated in the flowchart may be performed in an order other than that which is described. Also, it should be appreciated that not all of the blocks shown in the flow chart are required to be performed, that additional blocks may be added, and that some of the illustrated blocks may be substituted with other blocks.

It is contemplated that any part of any aspect or embodiment discussed in this specification can be implemented or combined with any part of any other aspect or embodiment discussed in this specification.

While particular embodiments have been described in the foregoing, it is to be understood that other embodiments are possible and are intended to be included herein. It will be clear to any person skilled in the art that modifications of and adjustments to the foregoing embodiments, not shown, are possible.

The invention claimed is:

1. A method for continuously fractionating particles within a viscoplastic fluid, the method comprising:

(a) flowing one stream of the viscoplastic fluid having the particles to be fractionated and a second type of particles therein ("source fluid") in a direction that is non-orthogonal relative to an axis of rotation such that the source fluid experiences laminar spiral Poiseuille flow;

(b) subjecting the source fluid to solid body rotation about the axis of rotation such that the particles to be fractionated experience centrifugal force equalling or exceeding resistive forces corresponding to the yield stresses of the viscoplastic fluid and such that the second type of particles experiences centrifugal force less than the resistive force corresponding to the yield stresses of the viscoplastic fluid while maintaining laminar spiral Poiseuille flow;

(c) continuing flowing and rotating the source fluid until the particles to be fractionated migrate sufficiently from the second type of particles to be separately collected from the second type of particles; and (d) collecting the particles that have been fractionated.

2. A method as claimed in claim 1 further comprising:

(a) flowing another stream of fluid ("destination fluid") parallel to the source fluid, wherein the source fluid is nearer to the axis of rotation than the destination fluid and wherein the destination and source fluids contact each other and comprise a stable multilayer flow;

(b) subjecting the source and destination fluids to solid body rotation about the axis of rotation such that the particles to be fractionated experience centrifugal force equalling or exceeding resistive forces corresponding to the yield stress of the source fluid and such that the second type of particles experiences centrifugal force less than the resistive force corresponding to the yield stress of the source fluid while maintaining the stable multilayer flow; and (c) continuing flowing and rotating the destination and source fluids until the particles to be fractionated migrate from the source fluid into the destination fluid, and wherein the particles to be fractionated are collected from the destination fluid.

3. A method as claimed in claim 2 wherein the destination fluid comprises a viscoplastic fluid, and wherein the source and destination fluids are subjected to solid body rotation such that the particles to be fractionated experience centrifugal force equalling or exceeding resistive forces corresponding to the yield stresses of the source and destination fluids and such that the second type of particles experiences centrifugal force less than the resistive force corresponding to the yield stresses of the source and destination fluids.

4. A method as claimed in claim 3 wherein the direction in which the destination and source fluids flow is parallel to the axis of rotation.

5. A method as claimed in claim 3 wherein the source and destination fluids comprise the same type of viscoplastic fluid.

6. A method as claimed in claim 3 further comprising subjecting the source and destination fluids to solid body rotation prior to contacting them together.

7. A method as claimed in claim 6 further comprising fully developing the velocity profiles of the source and destination fluids prior to contacting them together by pumping the source and destination fluids along the axis of rotation.

8. A method as claimed in claim 3, wherein the source and destination fluids are subjected to solid body rotation in a fractionation conduit and further comprising introducing the source and destination fluids simultaneously through a single inlet conduit to the fractionation conduit prior to being subjected to solid body rotation, wherein the source and destination fluids have sufficiently different densities such that they separate into two fractions prior to collecting the particles that have been fractionated.

* * * * *